US008905163B2

(12) United States Patent
Chen et al.

(10) Patent No.: US 8,905,163 B2
(45) Date of Patent: Dec. 9, 2014

(54) ROTARY DRILL BIT WITH IMPROVED STEERABILITY AND REDUCED WEAR

(75) Inventors: Shilin Chen, The Woodlands, TX (US); Riun Ashlie, Calgary (CA)

(73) Assignee: Halliburton Energy Services, Inc., Houston, TX (US)

( * ) Notice: Subject to any disclaimer, the term of this patent is extended or adjusted under 35 U.S.C. 154(b) by 560 days.

(21) Appl. No.: 12/593,137

(22) PCT Filed: Mar. 25, 2008

(86) PCT No.: PCT/US2008/058097

§ 371 (c)(1), (2), (4) Date: Sep. 25, 2009

(87) PCT Pub. No.: WO2008/118897

PCT Pub. Date: Oct. 2, 2008

(65) Prior Publication Data

US 2010/0133015 A1 Jun. 3, 2010

Related U.S. Application Data

(60) Provisional application No. 60/908,337, filed on Mar. 27, 2007.

(51) Int. Cl.

| | |
|---|---|
| ***E21B 10/43*** | (2006.01) |
| ***E21B 7/04*** | (2006.01) |
| ***E21B 17/10*** | (2006.01) |

(52) U.S. Cl.

CPC . *E21B 7/04* (2013.01); *E21B 10/43* (2013.01); *E21B 17/1092* (2013.01)

USPC ..... 175/431; 175/408

(58) Field of Classification Search

USPC ..... 175/401, 408, 412, 413, 431, 432

See application file for complete search history.

(56) References Cited

U.S. PATENT DOCUMENTS

| | | | | |
|---|---|---|---|---|
| 4,618,010 | A * | 10/1986 | Falgout et al. | 175/430 |
| 4,884,477 | A | 12/1989 | Smith et al. | 76/108 |
| 4,889,017 | A | 12/1989 | Fuller et al. | 76/108 A |

(Continued)

FOREIGN PATENT DOCUMENTS

| | | | |
|---|---|---|---|
| EP | 0193361 | 2/2006 | E21B 10/56 |

OTHER PUBLICATIONS

International Preliminary Report on Patentability; PCT/US2008/058097; pp. 9, Oct. 8, 2009.

(Continued)

*Primary Examiner* — Robert E Fuller

(74) *Attorney, Agent, or Firm* — Baker Botts L.L.P.

(57) ABSTRACT

A rotary drill bit having blades with cutting elements disposed on exterior portions thereof may be formed with either a continuous cutting zone or a substantially continuous cutting zone between the last cutting element on each blade and an adjacent gage pad. Such rotary drill bits may have improved steerability during the formation of a directional wellbore and/or may experience substantially reduced wear on gage pads and/or portions of each blade adjacent to respective gage pads. For some rotary drill bits an additional cutter may be disposed in one or more gage pads adjacent to the last cutting element. For other rotary drill bits a gage cutter may be disposed between and in close proximity to both the last cutting element and adjacent portions of the associated gage pad.

21 Claims, 11 Drawing Sheets

(56) References Cited

U.S. PATENT DOCUMENTS

| | | | | | |
|---|---|---|---|---|---|
| 5,033,559 | A | * | 7/1991 | Fischer | 175/431 |
| 5,163,524 | A | * | 11/1992 | Newton et al. | 175/408 |
| 5,423,389 | A | | 6/1995 | Warren et al. | 175/75 |
| 5,435,403 | A | | 7/1995 | Tibbitts | 175/432 |
| 5,467,836 | A | * | 11/1995 | Grimes et al. | 175/401 |
| 5,595,252 | A | | 1/1997 | O'Hanlon | 175/57 |
| 5,651,421 | A | * | 7/1997 | Newton et al. | 175/431 |
| 5,937,958 | A | * | 8/1999 | Mensa-Wilmot et al. | 175/398 |
| 6,003,623 | A | | 12/1999 | Miess | 175/430 |
| 6,039,131 | A | * | 3/2000 | Beaton | 175/376 |
| 6,062,325 | A | * | 5/2000 | Taylor et al. | 175/393 |
| 6,123,161 | A | | 9/2000 | Taylor | 175/397 |
| 6,131,677 | A | * | 10/2000 | Arfele et al. | 175/431 |
| 6,260,636 | B1 | | 7/2001 | Cooley et al. | 175/408 |
| 6,302,224 | B1 | | 10/2001 | Sherwood, Jr. | 175/397 |
| 6,349,780 | B1 | | 2/2002 | Beuershausen | 175/408 |
| 6,412,579 | B2 | * | 7/2002 | Fielder | 175/385 |
| 6,427,792 | B1 | * | 8/2002 | Roberts et al. | 175/431 |
| 6,481,511 | B2 | * | 11/2002 | Matthias et al. | 175/431 |
| 6,575,256 | B1 | * | 6/2003 | Doster | 175/431 |
| 6,659,207 | B2 | * | 12/2003 | Hoffmaster et al. | 175/391 |
| 6,845,828 | B2 | | 1/2005 | Boyce | 175/420.2 |
| 2001/0030063 | A1 | | 10/2001 | Dykstra et al. | 175/57 |
| 2002/0037200 | A1 | | 3/2002 | Boyce | 407/118 |
| 2005/0241858 | A1 | | 11/2005 | Eppink et al. | 175/325.1 |
| 2005/0247486 | A1 | * | 11/2005 | Zhang et al. | 175/57 |
| 2007/0144789 | A1 | * | 6/2007 | Johnson et al. | 175/431 |
| 2007/0205024 | A1 | * | 9/2007 | Mensa-Wilmot | 175/408 |

OTHER PUBLICATIONS

International Search Report and Written Opinion; PCT/US2008/058097; pp. 10, Aug. 7, 2008.

Canadian Office Action; Application No. 2,682,365; pp. 4, Apr. 29, 2014.

* cited by examiner

ROTARY DRILL BIT WITH IMPROVED STEERABILITY AND REDUCED WEAR

CROSS REFERENCE TO RELATED APPLICATIONS

This application is a U.S. National Stage Application of International Application No. PCT/US2008/058097 filed Mar. 25, 2008, which designates the United States of America, and claims the benefit of U.S. Provisional Application No. 60/908,337 filed Mar. 27, 2007, the contents of which are hereby incorporated by reference in their entirety.

TECHNICAL FIELD

The present disclosure is related to fixed cutter drill bits and particularly to fixed cutter drill bits having blades with cutting elements and gage pads disposed thereon.

BACKGROUND OF THE INVENTION

Various types of rotary drill bits, reamers, stabilizers and other downhole tools may be used to form a bore hole in the earth. Examples of such rotary drill bits include, but are not limited to, fixed cutter drill bits, drag bits, PDC drill bits and matrix drill bits used in drilling oil and gas wells. Cutting action associated with such drill bits generally requires weight on bit (WOB) and rotation of associated cutting elements into adjacent portions of a downhole formation. Drilling fluid may also be provided to perform several functions including washing away formation materials and other downhole debris from the bottom of a wellbore, cleaning associated cutting elements and cutting structures and carrying formation cuttings and other downhole debris upward to an associated well surface.

Fixed cutter rotary drill bits often have a bit body with a plurality of blades disposed on exterior portions of the bit body. Each blade typically includes a plurality of cutting elements or cutters disposed on exterior portions thereof. A gage pad may often be formed on each blade. Various types of compacts and cutting elements have sometimes been disposed within a gage pad. Cutting elements and/or compacts may sometimes be inserted into respective holes (not expressly shown) in exterior portions of a gage pad. Cutting elements disposed in such holes may sometimes be referred to as "drop in" cutting elements or cutters.

Gage pads typically cooperate with each other to define in part the largest outside diameter portion of an associated fixed cutter rotary drill bit. The gage pads may also define in part a nominal inside diameter of an associated wellbore formed by the fixed cutter rotary drill bit. At least one blade (and typically more than one blade) of prior fixed cutter rotary drill bits may often be formed with a significant gap or empty zone between the last cutting element on at least one blade and adjacent portions of an associated gage pad.

This gap may be formed because a typical cutter layout procedure usually starts with the first cutter disposed closest to bit center and towards the last cutter closest to the beginning of the associated gage pad following a specific overlapping rule. When the distance between the last cutter and the beginning of the associated gage pad is not big enough to fit another cutter, an empty zone or gap is typically formed on at least one blade.

Such gaps may have dimensions equal to or greater than corresponding dimensions of the last cutting element disposed on at least one blade. As a result, such gaps may leave partially uncut rings of formation material on the side wall of a wellbore formed by an associated rotary drill bit. For some applications noncutting elements such as tungsten carbide buttons or compacts may be placed within such gaps. For many straight hole drilling applications such noncutting elements may not interact with adjacent formation materials. However, for directional drilling, applications such noncutting elements may more frequently interact with the side wall of a wellbore because of side cutting action of an associated drill bit. The interaction of gage pads and noncutting elements with the side wall of a wellbore usually results in greater forces being applied to the associated drill bit as compared to forces applied to the bit when conventional cutting elements interact with adjacent formation materials. As a result, steerability of the associated drill bit may be significantly reduced.

Partially uncut rings of formation material may cause increased wear on gage pads of blades trailing a gap or noncontiguous cutting zone on at least one leading blade. Partially uncut rings of formation material may increase wear on exterior portions of at least one blade at the associated gap. Partially uncut rings of formation material may also reduce steerability of an associated fixed cutter rotary drill bit during directional drilling.

Various prior art references show examples of fixed cutter rotary drill bits having blades with a plurality of cutting elements or cutters disposed immediately adjacent to each other extending from an associated gage pad towards a bit rotational axis of an associated rotary drill bit. See for example, U.S. Pat. Nos. 5,607,024 and 5,265,685. Such cutting element layout procedure will often lead to 100% overlap, in a rotated profile, of the cutting elements having the same radial locations. As a result, uncut rings on the hole bottom may be formed which reduces significantly the rate of penetration and causes uneven wear of cutting elements. In addition, forming such rotary drill bits with cutting elements substantially covering all exterior portions of each blade extending from the associated gage pad may significantly increase costs associated with manufacturing such rotary drill bits. Also, placing a large number of cutting elements immediately adjacent to each other on exterior portions of an associated blade may be relatively difficult. Forming respective pockets or sockets in which each cutting element may be securely engaged generally takes up a significant amount of available space on each blade.

BRIEF SUMMARY OF THE INVENTION

In accordance with teachings of the present disclosure, a rotary drill bit may be formed with a plurality of blades having respective cutting elements disposed on each blade. An open space or gap may be provided between adjacent cutting elements. The last cutting element on each blade may have a cutting zone which overlaps the respective cutting zone of each last cutting element of the other blades of the rotary drill bit. For other applications the last cutting element on each blade may have a cutting zone which overlaps between approximately 100% and at least approximately 80% of the respective cutting zone of each last cutting element of the other blades of the rotary drill bit. The amount of overlap may be varied in accordance with teachings of the present disclosure to minimize or eliminate uncut rings of formation material on the inside diameter of an associated wellbore.

One aspect of the present disclosure may include selecting the location and orientation for cutters disposed on each blade of a fixed cutter drill bit based upon locating the first cutter of each blade at a respective distance from an associated bit rotational axis and locating the last cutter on each blade proximate an associated gage pad. The other cutters may then be disposed on exterior portions of each blade approximately equal spaced between the respective first cutter and the respective last cutter. For some embodiments spacing between the other cutters disposed on each blade may vary between the respective first cutter and the respective last cutter by following a pre-defined overlap rule. For some embodiments the dimensions and configuration of the other cutters disposed on each blade may be increased and/or decreased as compared with dimensions and configuration of the respective first cutter and the respective last cutter.

For some embodiments each cutting element may be disposed on a blade with a cutting face of each cutting element disposed immediately behind a leading edge of the blade. For other embodiments the last cutting element on at least one blade may be disposed between the next to last cutting element and the downhole edge of an associated gage pad with the cutting face of the last cutting element spaced from the leading edge of the blade. This arrangement may be used when the configuration and/or dimensions of a blade or other portions of an associated bit body do not provide sufficient space to place the cutting face of the last cutting element adjacent to the leading edge of the blade. Sometimes the size and/or configuration of the last cutting element may be reduced as compared to the next to last cutting element.

Rotary drill bits formed in accordance with teachings of the present disclosure may have a respective last cutting element and a respective next to last cutting element disposed on each blade with approximately one hundred percent (100%) overlap relative to all respective last cutting elements and next to last cutting elements disposed on the other blades. For other applications at least approximately eighty percent (80%) overlap may be provided for all respective last cutting elements and next to last cutting elements disposed on all blades. Providing cutting elements on adjacent blades with this range of overlap may improve steerability of an associated rotary drill bit.

Teachings of the present disclosure may be used to optimize the design of various features of a rotary drill bit including, but not limited to, number of blades, dimensions and configuration of each blade, number, configuration and dimensions of associated cutting elements, configuration and dimensions of associated cutting faces, number, location and orientation of both active and/or passive gages and location, configuration and dimensions of associated gage pads. The height of one or more gage pads and respective last cutting elements may be varied as measured along an associated bit rotational axis.

For some applications, the number, configuration and dimensions of cutting elements disposed between a respective first cutting element and a respective last cutting element may be varied to accommodate available space on exterior portions of each blade for associated cutting elements. For other applications, the configuration and dimensions of cutting elements disposed on each blade may be relatively uniform. One of the benefits of the present disclosure may include providing relatively large cutters or cutting elements disposed on portions of each blade which may be used during side cutting or tilting of an associated rotary drill bit to form a directional wellbore.

BRIEF DESCRIPTION OF THE DRAWINGS

A more complete and thorough understanding of present embodiments and advantages thereof may be acquired by referring to the following description taken in conjunction with the accompanying drawings, in which like reference numbers indicate like features, and wherein.

DETAILED DESCRIPTION OF THE DISCLOSURE

Figure 1:
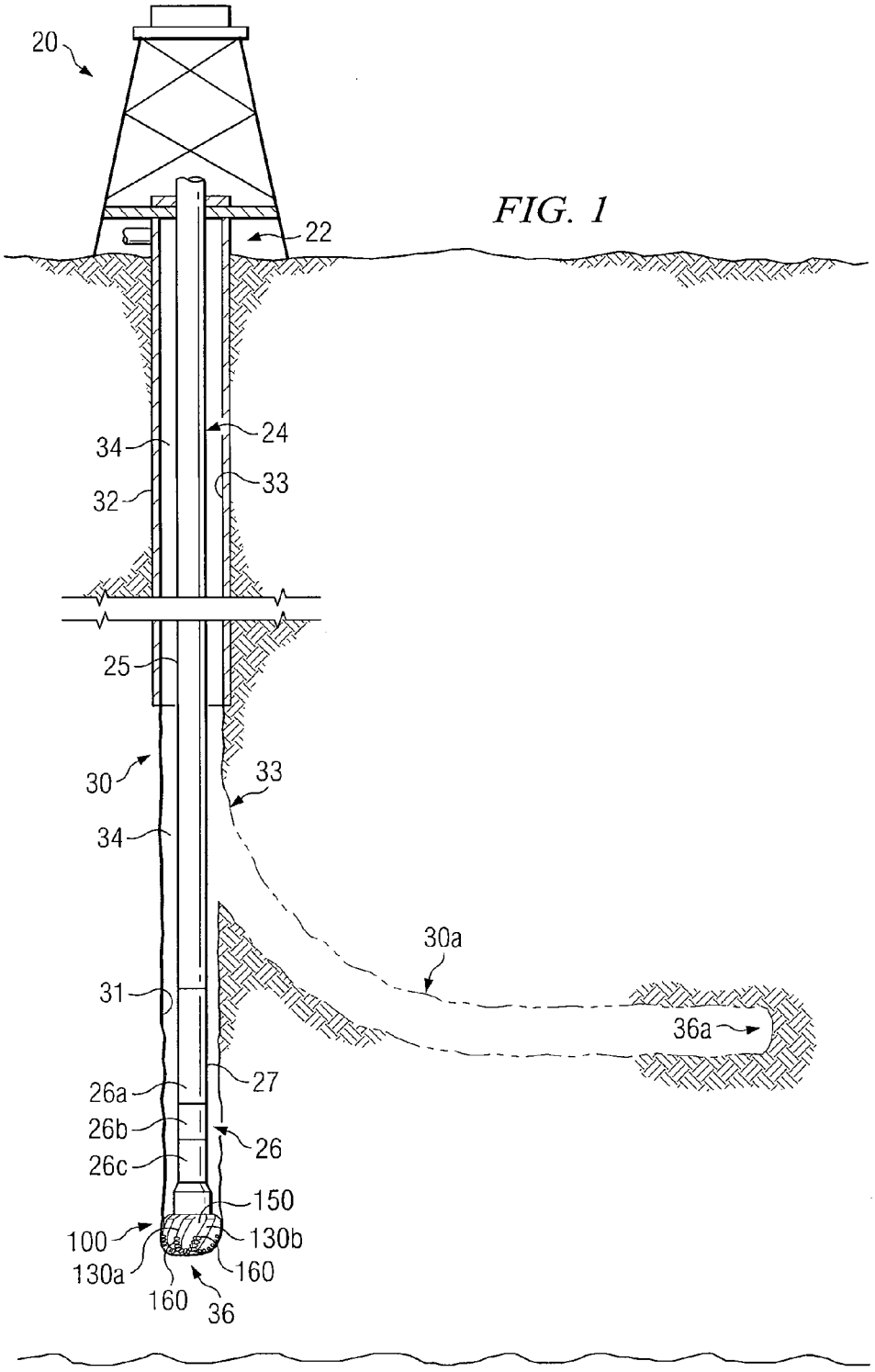
FIG. 1 is a schematic drawing in section and in elevation with portions broken away showing examples of wellbores which may be formed with a rotary drill bit incorporating teachings of the present disclosure.

Preferred embodiments of the disclosure and some related advantages may be understood by reference to FIGS. 1-12C wherein like numbers refer to same and like parts.

The term "bottom hole assembly" or "BHA" may be used in this application to describe various components and assemblies disposed proximate to a rotary drill bit at the downhole end of a drill string. Examples of components and assemblies (not expressly shown) which may be included in a bottom hole assembly or BHA include, but are not limited to, a bent sub, a downhole drilling motor, a near bit reamer, stabilizers and down hole instruments. A bottom hole assembly may also include various types of well logging tools (not expressly shown) and downhole instruments associated with directional drilling of a wellbore. Examples of such logging tools and/or directional drilling equipment may include, but are not limited to, acoustic, neutron, gamma ray, density, photoelectric, nuclear magnetic resonance and/or any other commercially available logging instruments.

The terms "cutting element" and "cutting elements" may be used in this application to include various types of cutters, compacts, PDC cutters, inserts and gage cutters satisfactory for use with a wide variety of rotary drill bits. Impact arrestors, which may be included as part of the cutting structure on some types of rotary drill bits, sometimes function as cutting elements to remove formation materials from adjacent portions of a wellbore. Polycrystalline diamond compacts (PDC) and tungsten carbide inserts are often used to form cutting elements for rotary drill bits. A wide variety of other types of hard, abrasive materials may also be satisfactorily used to form such cutting elements.

The term "cutting structure" may be used in this application to include various combinations and arrangements of cutting elements, impact arrestors and/or gage cutters disposed on exterior portions of a rotary drill bit. Some fixed cutter drill bits may include one or more blades disposed on and extending from an associated bit body. Such blades may also be referred to as "cutter blades". A plurality of cutters may be disposed on each blade. Various configurations of blades and cutters may be used to form cutting structures for a fixed cutter drill bit in accordance with teachings of the present disclosure.

Various features of the present disclosure may be described with respect to rotary drill bits having five (5) blades disposed on exterior portions of an associated bit body. However, teaching of the present disclosure may be used to form rotary drill bits having any number of blades (3, 4, 5, 6, 7 or more) as appropriate for each rotary drill bit design and/or anticipated downhole drilling conditions.

The term "rotary drill bit" may be used in this application to include various types of fixed cutter drill bits, drag bits, matrix drill bits and steel body drill bits operable to form a wellbore extending through one or more downhole formations. Rotary drill bits and associated components formed in accordance with teachings of the present disclosure may have many different designs, configurations and dimensions.

The terms "downhole" and "up hole" may be used in this application to describe the location of various components of a rotary drill bit relative to portions of the rotary drill bit which engage the bottom or end of a wellbore to remove adjacent formation materials. For example an "up hole" component may be located closer to an associated drill string or bottom hole assembly as compared to a "downhole" component located closer to the bottom or end of an associated wellbore. See for example uphole edges 144, 244, 344, 444, 544, 644 and 744 of respective gage pads 140, 240, 340, 440, 540, 640, and 740 which will be located closer to an associated drill string or bottom hole assembly as compared to downhole edges 142, 242, 342, 442, 542, 546, and 742.

Teachings of the present disclosure may be used to optimize the design of active and/or passive gages associated with a rotary drill bit. One of the differences between a "passive gage" and an "active gage" associated with rotary drill bits may be that a passive gage will generally not remove formation materials from the sidewall of a wellbore or bore hole. An active gage of a rotary drill bit may at least partially cut into the sidewall of a wellbore or bore hole and remove some formation material, particularly during directional drilling. A passive gage of a rotary drill bit may plastically or elastically deform a sidewall, particularly during directional drilling.

Various computer programs and computer models may be used to design cutting elements, cutting faces, blades and associated rotary drill bits in accordance with teachings of the present disclosure. Examples of methods and systems which may be used to design and evaluate performance of cutting elements and rotary drill bits incorporating teachings of the present disclosure are shown in copending U.S. Patent Applications entitled "Methods and Systems for Designing and/or Selecting Drilling Equipment Using Predictions of Rotary Drill Bit Walk," application Ser. No. 11/462,898, filing date Aug. 7, 2006 (now granted); U.S. patent application entitled "Methods and Systems of Rotary Drill Bit Steerability Prediction, Rotary Drill Bit Design and Operation," application Ser. No. 11/462,918, filed Aug. 7, 2006 (now granted) and U.S. patent application entitled "Methods and Systems for Design and/or Selection of Drilling Equipment Based on Wellbore Simulations," application Ser. No. 11/462,929, filing date Aug. 7, 2006 (now granted). The previous co-pending patent applications and any resulting U.S. Patents are incorporated by reference in this Application.

Various features of the present disclosure may be described with respect to rotary drill bits 100, 300, 400, 500, 600 and 700 and respective first cutting elements 160*a*, 360*a*, 460*a*, 560*a*, 660*a* and 760*a*. Also, various features of the present disclosure may be described with respect to respective last cutting elements 160*k*, 360*k*, 460*k*, 560*k*, 660*k* and 760*k* of corresponding rotary drill bits 100, 300, 400, 500, 600 and 700.

FIG. 1 is a schematic drawing in elevation and in section with portions broken away showing examples of wellbores or bore holes which may be formed using a rotary drill bit incorporating teachings of the present disclosure. Various aspects of the present disclosure may be described with respect to drilling rig 20 rotating drill string 24 and attached rotary drill bit 100 to form a wellbore.

Various types of drilling equipment such as a rotary table, mud pumps and mud tanks (not expressly shown) may be located at well surface or well site 22. Drilling rig 20 may have various characteristics and features associated with a "land drilling rig." However, rotary drill bits incorporating teachings of the present disclosure may be satisfactorily used with drilling equipment located on offshore platforms, drill ships, semi-submersibles and drilling barges (not expressly shown).

Rotary drill bits 100, 300, 400, 500, 600 and 700 (See FIGS. 1 and 4-12C) may be attached to a wide variety of drill strings extending from an associated well surface. For some applications rotary drill bit 100 may be attached to bottom hole assembly 26 at the extreme end of drill string 24. Drill string 24 may be formed from sections or joints of generally hollow, tubular drill pipe (not expressly shown). Bottom hole assembly 26 will generally have an outside diameter compatible with exterior portions of drill string 24.

Bottom hole assembly 26 may be formed from a wide variety of components. For example components 26*a*, 26*b* and 26*c* may be selected from a group including, but not limited to, drill collars, rotary steering tools, directional drilling tools and/or downhole drilling motors. The number of components such as drill collars and different types of components included in a bottom hole assembly will depend upon anticipated downhole drilling conditions and the type of wellbore which will be formed by drill string 24 and rotary drill bit 100.

Drill string 24 and rotary drill bit 100 may be used to form a wide variety of wellbores and/or bore holes such as generally vertical wellbore 30 and/or directional wellbore or horizontal wellbore 30*a* as shown in FIG. 1. Various directional drilling techniques and associated components of bottomhole assembly 26 may be used in combination with rotary drill bit 100 to form directional wellbore 30*a* extending from wellbore 30 proximate kickoff location 33.

Wellbore 30 may be defined in part by casing string 32 extending from well surface 22 to a selected downhole location. Portions of wellbore 30 as shown in FIG. 1 which do not include casing 32 may be described as "open hole". Various types of drilling fluid may be pumped from well surface 22 through drill string 24 to attached rotary drill bit 100. The drilling fluid may be circulated back to well surface 22 through annulus 34 defined in part by outside diameter 25 of drill string 24 and inside diameter 31 of wellbore 30. Inside diameter 31 may also be referred to as the "sidewall" of wellbore 30. Annulus 34 may also be defined by outside diameter 25 of drill string 24 and inside diameter 31 of casing string 32.

Formation cuttings may be formed by rotary drill bit 100 engaging formation materials proximate end 36 of wellbore 30. Drilling fluids may be used to remove formation cuttings and other downhole debris (not expressly shown) from end 36 of wellbore 30 to well surface 22. End 36 may sometimes be described as "bottom hole" 36. Formation cuttings may also be formed by rotary drill bit 100 engaging end 36*a* of horizontal wellbore 30*a*.

As shown in FIG. 1, drill string 24 may apply weight to and rotate rotary drill bit 100 to form wellbore 30. Inside diameter or sidewall 31 of wellbore 30 may correspond approximately with the combined outside diameter of blades 130*a*-130*e* extending from rotary drill bit 100. For some rotary drill bits such as represented by rotary drill bit 100, the largest or maximum outside diameter may be defined in part by gage pads 140*a*-140*e* disposed on exterior portions of respective blades 130*a*-130*e*. Additional details concerning blades 130*a*-130*e* and gage pads 140*a*-140*e* may be discussed with respect to FIGS. 4 and 10.

Rate of penetration (ROP) of a rotary drill bit is typically a function of both weight on bit (WOB) and revolutions per minute (RPM). For some applications a downhole motor (not expressly shown) may be provided as part of bottom hole assembly 26 to also rotate rotary drill bit 100. The rate of penetration of a rotary drill bit is generally stated in feet per hour.

In addition to rotating and applying weight to rotary drill bit 100, drill string 24 may provide a conduit for communicating drilling fluids and other fluids from well surface 22 to drill bit 100 at end 36 of wellbore 30. Such drilling fluids may be directed to flow from drill string 24 to respective nozzles (not expressly shown) provided in rotary drill bit 100.

Rotary drill bit 100 will often be substantially covered by a mixture of drilling fluid, formation cuttings and other downhole debris while drilling string 24 rotates rotary drill bit 100. Drilling fluid exiting from one or more nozzles (not expressly shown) may be directed to flow generally downwardly between adjacent blades 130*a*-130*e* and flow under and around downhole portions of rotary drill bit 100.

Figure 2:
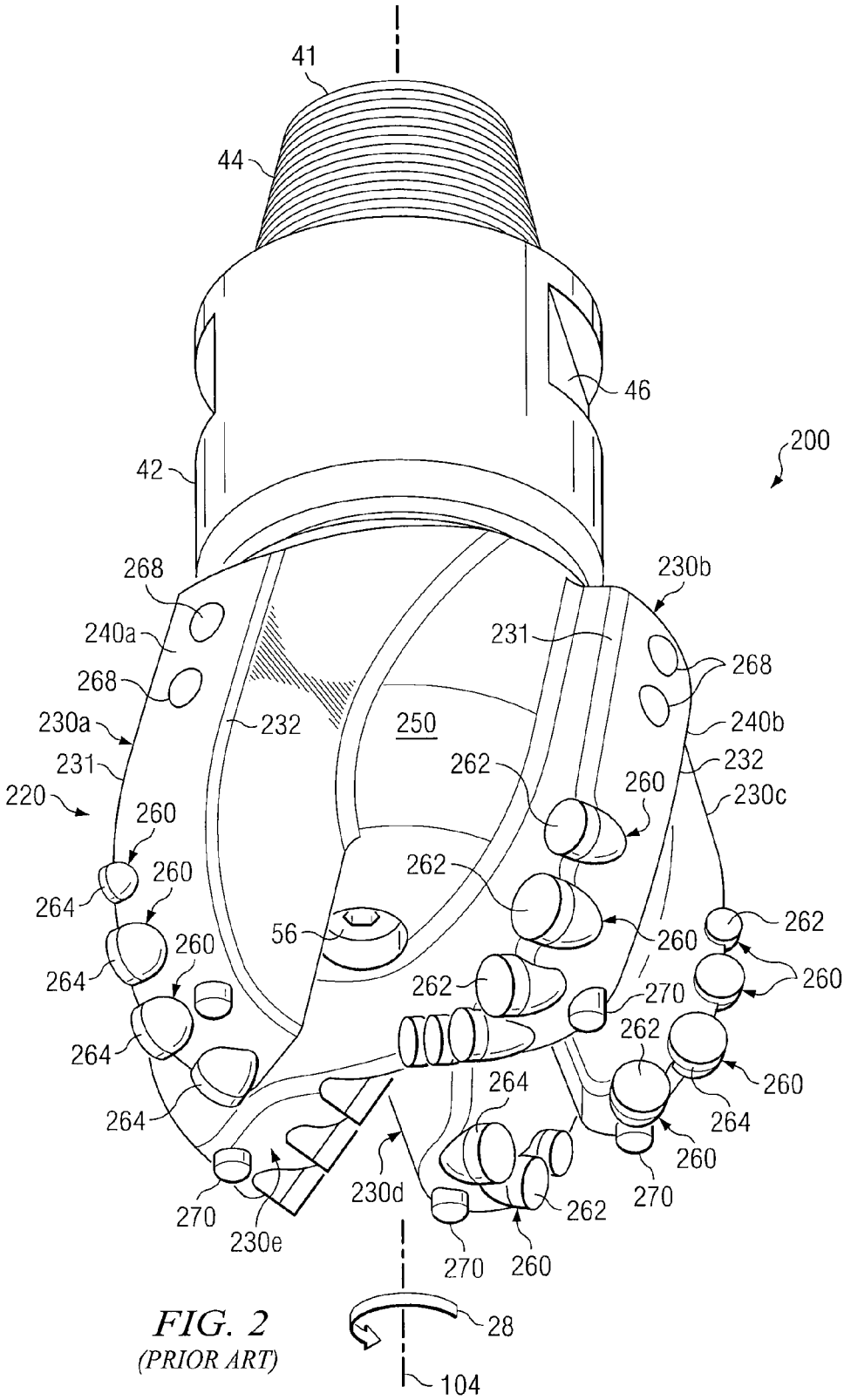
FIG. 2 (PRIOR ART)
FIG. 2 is a schematic drawing showing an isometric view of one example of a prior art fixed cutter rotary drill bit.

FIG. 2 is a schematic drawing showing one example of a prior art rotary drill bit having a bit body with a plurality of blades disposed on and extending from an associated bit body. For some applications bit bodies associated with fixed cutter drill bits may be formed in part from a matrix of very hard materials. For other applications bit bodies associated with fixed cutter drill bits may be machined from various metal alloys satisfactory for use in drilling wellbores in downhole formations. Examples of matrix type bit bodies and associated rotary drill bits are shown in U.S. Pat. Nos. 4,696,354 and 5,099,929.

Rotary drill bit 200 as shown in FIG. 2 may include bit body 220 with a plurality of blades 230*a*-230*e* extending therefrom. Bit body 220 may also include upper portion or shank 42 with American Petroleum Institute (API) drill pipe threads 44 formed thereon. API threads 44 may be used to releasably engage rotary drill bit 200 with a bottomhole assembly whereby rotary drill bit 200 may be rotated relative to bit rotational axis 104 in response to rotation of an associated drill string and/or downhole drilling motor. Bit breaker slots 46 may also be formed on exterior portions of upper portion or shank 42 for use in engaging and disengaging rotary drill bit 200 from an associated drill string.

A longitudinal bore (not expressly shown) may extend from end 41 through upper portion 42 and into bit body 220. The longitudinal bore may be used to communicate drilling fluids from a drill string to one or more nozzles 56 disposed in bit body 220. A plurality of respective junk slots or fluid flow paths 250 may be formed between respective pairs of blades 230*a*-230*e*. Blades 230*a*-230*e* may spiral or extend at an angle relative to associated bit rotational axis 104. For some applications, blades 230*a*-230*e* and associated fluid flow paths 250 may have generally symmetrical configurations and dimensions relative to bit rotational axis 104 and exterior portions of associated bit body 220. For other applications, blades 230*a*-230*e* and associated fluid flow paths 250 may have asymmetrical configurations and/or dimensions relative to bit rotational axis 104 and exterior portions of bit body 220.

A plurality of cutting elements 260 may be disposed on exterior portions of each blade 230*a*-230*e*. For some applications cutting elements 260 may include a generally cylindrical substrate (not expressly shown) with layer 264 of hard cutting material disposed on one end of the associated substrate. Cutting surface or cutting face 262 may be formed on layer 264 opposite from the associated substrate. For some applications, layer 264 may have the general configuration of a disc with a diameter approximately equal to a corresponding diameter of the associated substrate. The thickness of layer 264 may be substantially less than the length of the associated substrate.

Cutting elements 260 may often be disposed on respective blades 230*a*-230*e* with cutting face 262 of each cutting element 260 located adjacent to associated leading edge 231. Each cutting face 262 will generally be oriented in the direction of bit rotation. A gap or open space will generally be provided between adjacent cutting elements 260.

Various configurations and sizes of cutting elements, substrates and associated layers of hard, cutting material may be used with a rotary drill bit incorporating teachings of the present disclosure. Some examples of such cutting elements are shown in copending U.S. Provisional Patent Application Ser. No. 60/887,459 entitled Rotary Drill Bits with Protected Cutting Elements and Methods, filed on Jan. 31, 2007. Various tungsten carbide alloys and other hard materials associated with drilling wellbores may be used to form substrates for cutting elements 260. Layers 264 may be formed from diamond particles, polycrystalline diamond and other hard, cutting materials used to drill wellbores in downhole formations.

For some applications each cutting element 260 may be disposed in a respective socket or pocket (not expressly shown) formed on exterior portions of respective blades 230*a*-230*e*. Various parameters associated with rotary drill bit 200 may include, but are not limited to, location and configuration of blades 230*a*-230*e*, junk slots 250 and cutting elements 260.

Some prior art rotary drill bits may include an active or passive gage surface or gage pad disposed on each blade. For rotary drill bit 200 each blade 230*a*-230*e* may include respective gage surfaces or gage pads 240*a*-240*e*. For some applications compacts 268 may be disposed on exterior portion of gage pads 240*a*-240*e*. Compacts 268 may be formed from a wide variety of hard materials, including but not limited to diamond particles, polycrystalline diamonds (PDC) and/or tungsten carbide alloys. A wide variety of noncutting elements and buttons (not expressly shown) may also be disposed on gage pads 240*a*-240*e*. Gage cutters (not expressly shown) may sometimes be disposed on one or more blades 240*a*-240*e* adjacent to associated gage pads 240*a*-240*e*. Such gage cutters are often smaller than cutting elements 260 disposed on blades 240*a*-240*e*.

Rotary drill bit 200 also includes respective impact arrestors and/or secondary cutters 270 disposed on each blade 230*a*-230*e*. Additional information concerning gage cutters and hard cutting materials may be found in U.S. Pat. Nos. 7,083,010, 6,845,828, and 6,302,224. Additional information concerning impact arrestors may be found in U.S. Pat. Nos. 6,003,623, 5,595,252 and 4,889,017.

Rotary drill bits are generally rotated clockwise during formation of a wellbore. See arrows 28 in FIGS. 2-6, 7A, 8A, and 9-11. Cutting elements and/or blades may be generally described as "leading" or "trailing" with respect to other cutting elements and/or blades disposed on exterior portions of an associated rotary drill bit. For example blade 230*a* as shown in FIG. 2 may be generally described as leading blade 230*b* and may be generally described as trailing blade 230*e*. In the same respect cutting elements 260 disposed on blade 230*a* may be generally described as leading corresponding cutting elements 260 disposed on blade 230*b*. Cutting elements 260 disposed on blade 230*a* may be generally described as trailing corresponding cutting elements 260 disposed on blade 230*e*.

Each blade 230*a*-230*e* may also be described as having respective leading edge 231 and respective trailing edge 232. Cutting elements 260 may be disclosed adjacent to respective leading edge 231 with cutting surface 262 of each cutting element 260 oriented in the direction of rotation of rotary drill bit 200. See arrow 28 in FIG. 2.

During rotation of a fixed cutter rotary drill bit, associated cutting elements will generally cut into and form a kerf or groove (not expressly shown) in adjacent portions of a downhole formation. The dimensions and configuration of each kerf will typically depend on factors such as dimensions and configuration of a respective cutting layer disposed on each cutting element, weight on bit (WOB) and rate of penetration (ROP) of an associated rotary drill bit, radial distance and orientation of each cutting element from an associated bit rotational axis, type of downhole formation materials (soft, medium, hard, hard stringers, etc.) and amount of formation material removed by each cutting element. For cutting elements disposed on a fixed cutter rotary drill bit, rate of penetration, weight on bit, total number of cutting elements, size and configuration of each cutting element, and respective radial position of each cutting element may determine average width and depth of a respective kerf formed by each cutting element.

Figure 3:
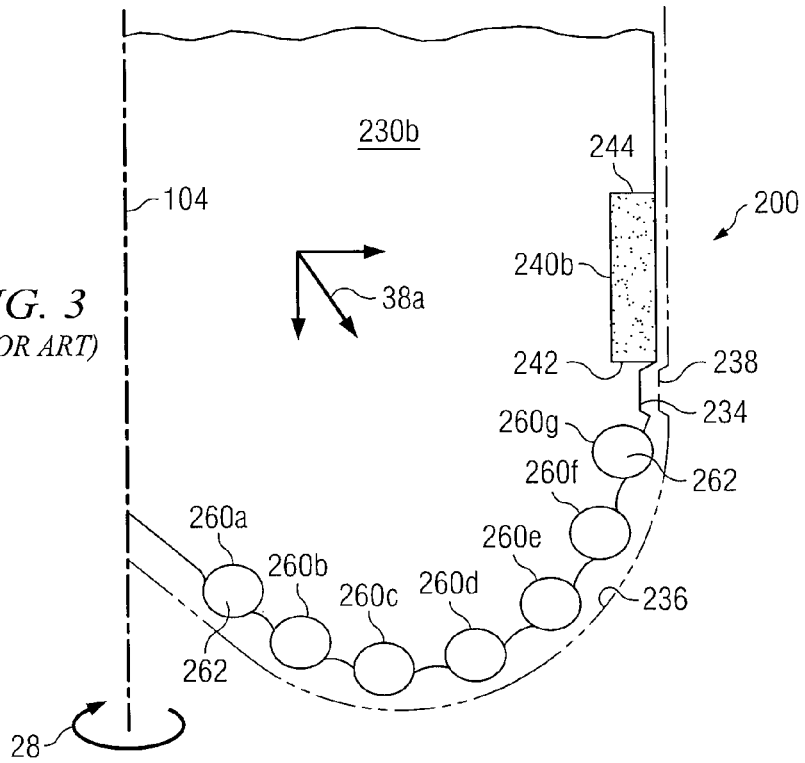
FIG. 3 (PRIOR ART)
FIG. 3 is a schematic drawing in section with portions broken away showing another example of a prior art fixed cutter rotary drill bit.

For prior art rotary drill bits having bit bodies with blades, cutting elements are often positioned on exterior portions of each blade by placing a respective first cutting element at a first distance relative to an associated bit rotational axis. The remaining cutting elements on each blade may typically be spaced a desired distance from the respective first cutting element. For prior art rotary drill bits such as shown in FIGS. 2 and 3 this arrangement often results in a gap or noncontiguous cutting zone disposed between the last cutting element and an adjacent gage pad on at least one blade. Such gaps or noncontiguous cutting zones may substantially negatively affect steerability and/or other characteristics of an associated rotary drill bit during formation of a directional wellbore.

FIG. 3 shows a schematic representation of blade 230*b* associated with rotary drill bit 200 of FIG. 2. Typically, the location for first cutting element 260*a* on exterior portions of blade 230*b* may be selected based on an optimum radial distance or location relative to bit rotational axis 104. The other cutting elements 260*b*-260*g* may be disposed on exterior portions of blade 230*b* with varied spacing therebetween determined by a pre-defined overlap rule. Respective cutting face 262 on each cutting element 260 may be oriented in the direction of rotation of rotary drill bit 200 to interact with adjacent formation material. See arrow 28.

The respective radial distance or location relative to bit rotational axis 104 and respective first cutting elements 260*a* of blades 230*a*-230*e* may be varied so that corresponding cutting elements 260 in trailing blades 230 may overlap or be disposed between cutting elements 260 on associated leading blades 230. Varying the location of respective first cutting elements 260*a* on each blade 230*a*-230*e* may result in cutting elements 260 of blades 230*a*-230*e* being positioned to form respective kerfs which may more uniformly remove formation materials from end or bottom 236 of an associated wellbore. Varying the location of each first cutting element 260*a* relative to bit rotational axis 104 also minimizes forming an uncut core of formation material proximate the center of end or bottom 236 of an associated wellbore.

An open space, gap, noncontinuous or noncontiguous cutting zone may often be created on exterior portions of one or more blades 230*a*-230*e* between respective last cutting element 260 and downhole edge 242 of associated gage pad 240 as a result of spacing the other cutting elements 260 relative to respective first cutting element 260*a*. For example, gap 234 is shown in FIG. 3 between last cutting element 260*g* and downhole edge 242 of gage pad 240*b*. Uncut formation material or bridge 238 may be formed on the inside diameter of an associated wellbore as a result of gap 234 if the bit has any side cutting action. At high rates of penetration, gap 234 may form a relatively long spiraling bridge 238 on the inside diameter of a wellbore. Bridge or uncut formation material 238 may be removed by one or more trailing gage pads 240. However, the force required to remove bridge or uncut material 238 using gage pads 240 may be substantially greater than the force required to remove uncut material using cutting elements 260*a*-260*g*.

Increased amounts of force required to remove small bridges and/or uncut material from the inside diameter of a wellbore using gage pads 240 may reduce steerability of an associated rotary drill bit, may increase wear on exterior portions of blades 230*a*-230*e* located between respective last cutting elements 260*g* and downhole edge 242 of associated gage pads 240 and/or increase wear on exterior portions of gage pads 240 adjacent to respective downhole edge 242.

During formation of a directional wellbore, such as wellbore 30*a* as shown in FIG. 1, a rotary drill bit may generally move at an angle offset relative to vertical. For example, arrow 38*a* as shown in FIG. 3 may represent an angle at which rotary drill bit 200 may move relative to vertical to form a directional wellbore. The effect of leaving bridge or uncut material 238 on the inside diameter of a wellbore may be particularly significant with respect to steerability of rotary drill bit 200 during directional drilling.

Figure 4:
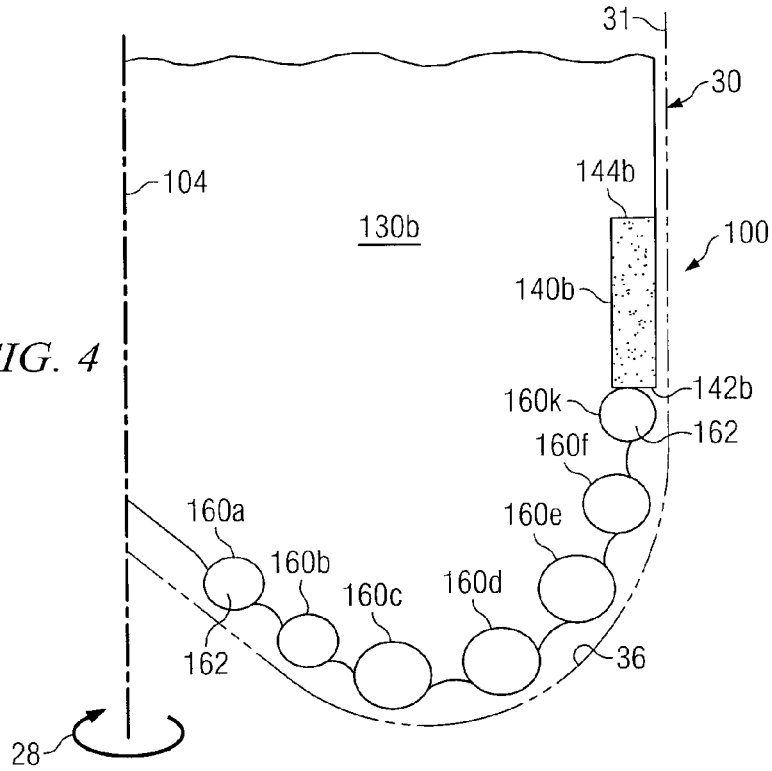
FIG. 4 is a schematic drawing in section with portions broken away showing one example of a rotary drill bit with cutting elements disposed on a blade in accordance with teachings of the present disclosure.
Figure 9:
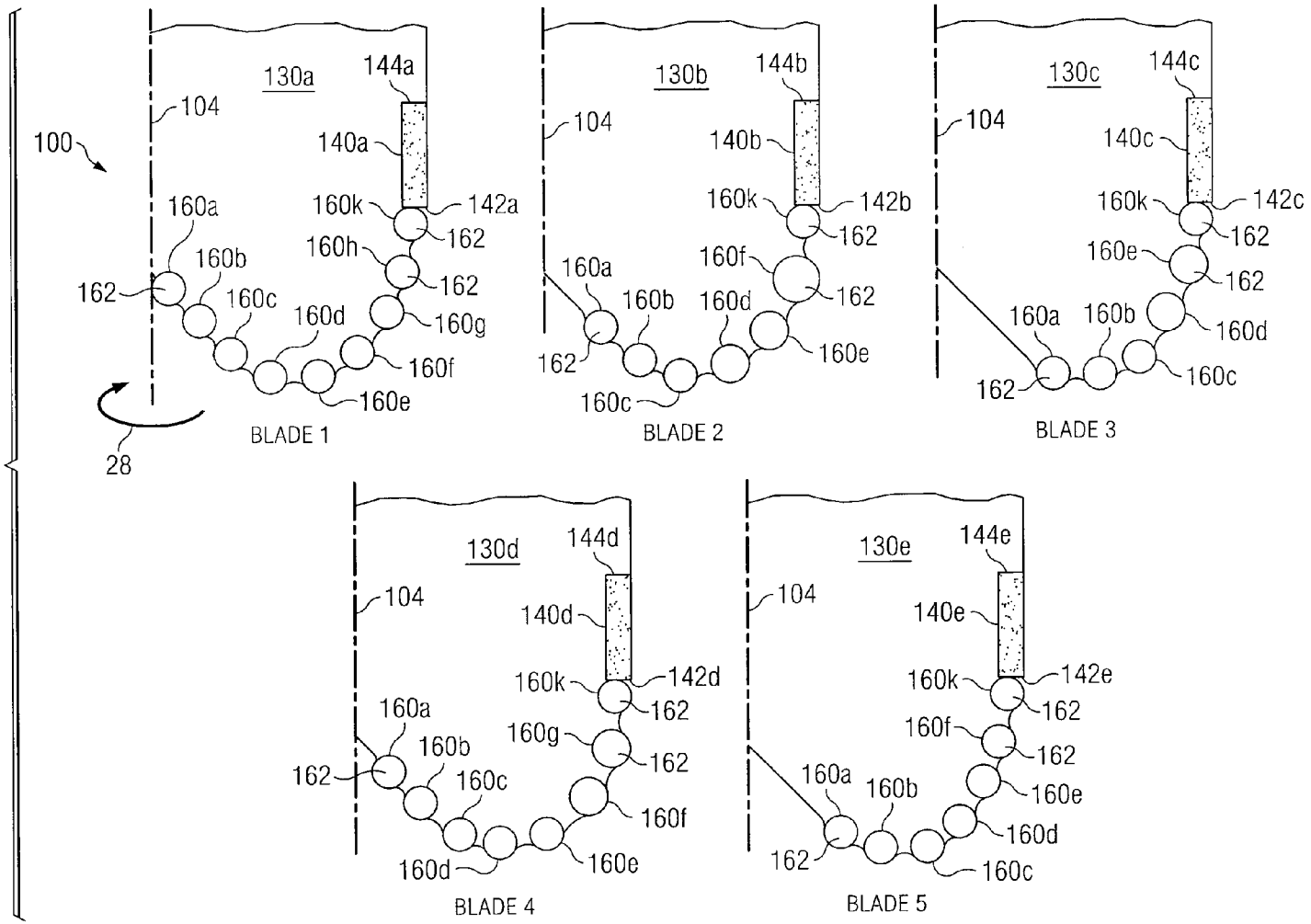
FIG. 9 is a schematic drawing in section with portions broken away showing five blades of a rotary drill bit having respective cutting elements disposed on each blade in accordance with teachings of the present disclosure.

FIGS. 1, 4 and 9 show one example of a fixed cutter rotary drill bit incorporating teachings of the present disclosure. Various aspects of the present disclosure may be described with respect to blades 130, respective cutting elements 160 and respective gage pads 140 associated with rotary drill bit 100. Each cutting element 160 may include respective cutting face 162 disposed on a layer of hard cutting material (not expressly shown). Blades 130*a*-130*e* associated with rotary drill bit 100 are shown in more detail in FIG. 9.

For purposes of describing various features of the present disclosure cutting elements 160 may be designated as 160*b*, 160*c*, 160*d*, etc. disposed between respective first cutting elements 160*a* located closest to associated bit rotational axis 104 and respective last cutting elements 160*k* located proximate associated gage pads 140*a*-140*e*. The number, size, configuration and/or location of respective cutting elements 160 disposed on exterior portions of each blade 130*a*-130*e* may be varied according to teachings of the present disclosure.

One aspect of the present disclosure may include determining respective locations for each first cutting element 160*a* on exterior portion of each blade 130*a*-130*e* relative to associated bit rotational axis 104. For blade 130*a* respective first cutting element 160*a* may be disposed on exterior portions of blade 130*a* relatively close to bit rotational axis 104. First cutting element 160*a* of blade 130*b* may be disposed at an increased distance from bit rotational axis 104 as compared to first cutting element 160*a* on blade 130*a*. In a similar manner respective first cutting element 160*a* of blade 130*c* may be disposed at an even greater distance from bit rotational axis 104.

Respective first cutting element 160*a* of blade 130*d* may be disposed at a position relative to bit rotational axis 104 intermediate the location of first cutting element 160*a* on blade 130*a* and first cutting element 160*a* on blade 130*b*. In a similar manner respective first cutting element 160*a* of blade 130*e* may be disposed at a position relative to bit rotational axis 104 intermediate the location of first cutting element 160*a* on blade 130*b* and first cutting element 160*a* on blade 130*c*. The location of each first cutting element may be varied based on various parameters of an associate rotary drill bit, blades, cutting elements and cutting surfaces. The location of each first cutting element may also be varied based on anticipated downhole drilling conditions.

The location of respective last cutting elements 160*k* on each blade 130*a*-130*e* may then be selected to be immediately adjacent to respective downhole edge 142*a* of associated gage pads 140*a*-140*e*. The other respective cutting elements 160 may then be disposed on exterior portions of each blade 130*a*-130*e* between respective first cutting elements 160*a* and respective last cutting elements 160*k*. See FIG. 9.

A gap or open space may be provided between adjacent cutting elements 160 to optimize downhole drilling performance versus the cost of adding additional cutting elements to exterior portions of each blade. Also, spacing adjacent cutting elements 160 from each other may allow increasing strength and/or optimizing orientation of respective pockets or sockets (not expressly shown) disposed on exterior portions of each blade 130.

For embodiments represented by rotary drill bit 100, blade 130*a* may have cutting elements 160*a*-160*i* disposed on exterior portions thereof with relatively uniform dimensions and configurations. On blade 130*b* of rotary drill bit 100 the configuration and/or dimensions of cutting elements 160*a*-160*f* and 160*k* may vary. For example cutting element 160*f* may have a larger diameter and larger cutting face 162 as compared with the other cutting elements 160 disposed on blade 130*b*. Respective last cutting elements 160*k* disposed on each blade 130*a*-130*e* may have approximately the same configuration and dimensions.

Placing the last cutting element on each blade immediately adjacent to a downhole edge of an associated gage pad may provide a substantially continuous or contiguous cutting zone from each last cutting element to the associated gage pad. Placing respective last cutting elements 160*k* of associated blades 130*a*-130*e* adjacent to respective downhole edge 142*a*-142*e* of associated gage pads 140*a*-140*e* may result in cutting face 162 of each last cutting elements 160*k* substantially overlapping cutting face 162 of the other last cutting elements 160*k*.

Respective kerfs formed by each last cutting element 160*k* of blades 130*a*-130*e* may also substantially overlap each other. Respective last cutting elements 160*k* for each blade 130*a*-130*e* may be at approximately the same height measured parallel to associated bit rotational axis 104. For other embodiments (See FIG. 12A) the height of one or more gage pads and one or more last cutting elements may vary as measured along or parallel to associated bit rotational axis 104.

For embodiments represented by rotary drill bit 100 cutting face 162 of each last cutting element 160*k* may overlap respective cutting faces 162 of the other last cutting elements 160*k* by approximately one hundred percent (100%). The overlap of respective kerfs formed by each last cutting element 160*k* may be approximately one hundred percent (100%). See FIG. 9.

For some embodiments a respective next to last cutting element may be disposed on each blade such that each next to last cutting element may overlap approximately one hundred percent (100%) with the other next to last cutting elements. For example, next to last cutting element 160*h* may be disposed at a location on blade 130*a* which overlaps approximately one hundred percent (100%) with next to last cutting element 160*f* disposed on blade 130*b*, next to last cutting element 160*e* disposed on blade 130*c*, next to last cutting element 160*g* disposed on blade 130*d* and next to last cutting element 160*h* disposed on blade 130*e*. See FIG. 9. For other applications each next to last cutting element may overlap the other next to last cutting elements by approximately eighty percent (80%).

Figure 5:
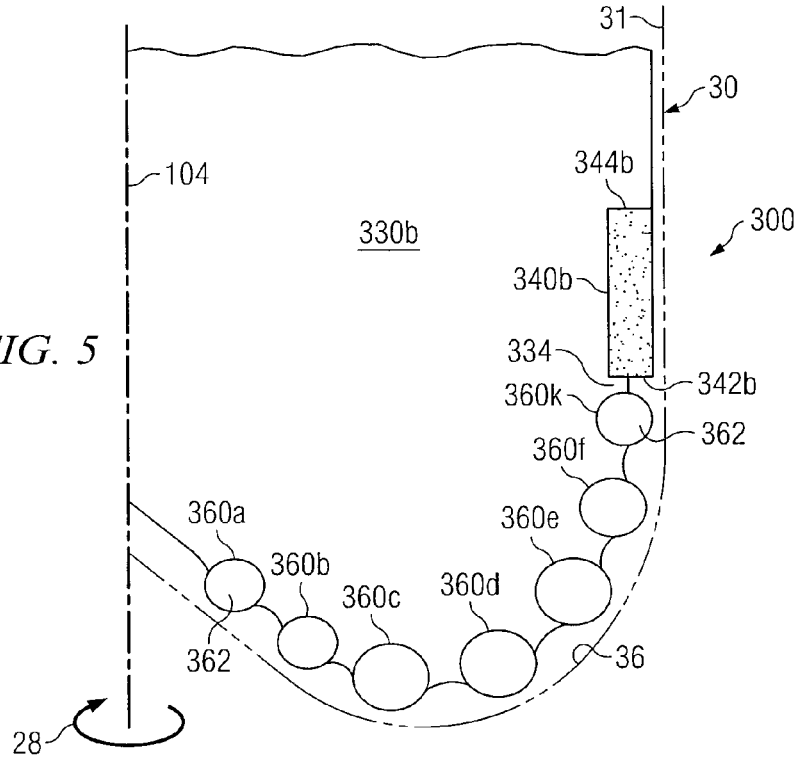
FIG. 5 is a schematic drawing in section with portions broken away showing another example of a rotary drill bit with cutting elements disposed on a blade in accordance with teachings of the present disclosure.
Figure 10:
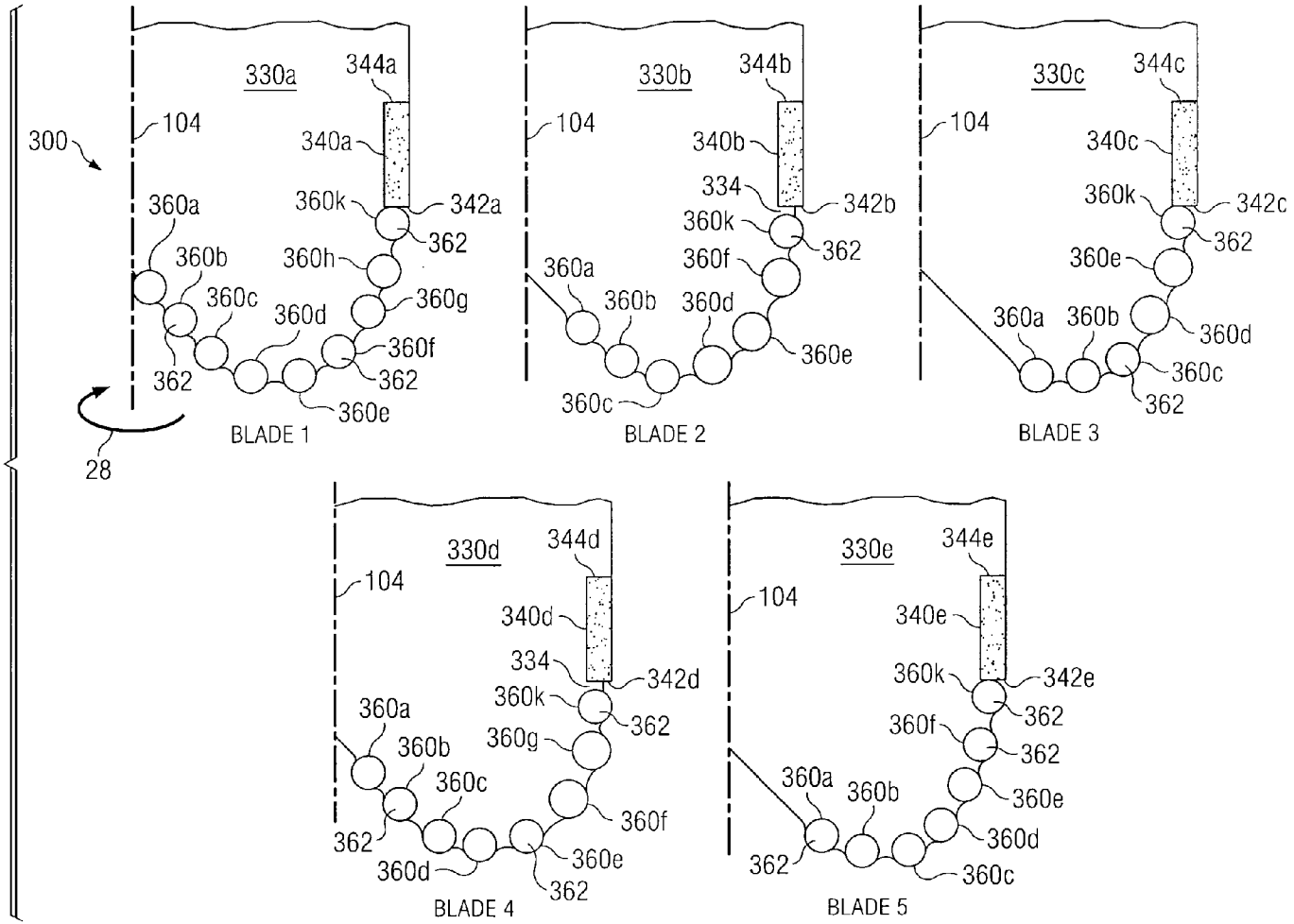
FIG. 10 is a schematic drawing in section with portions broken away showing another example of five blades of a rotary drill bit having respective cutting elements disposed on each blade in accordance teachings of the present disclosure.

FIGS. 5 and 10 show a further example of a fixed cutter rotary drill bit incorporating teachings of the present disclosure. Various aspects of the present disclosure may be described with respect to blades 330*a*-330*e*, respective cutting elements 360 and respective gage pads 340. As previously noted with respect to rotary drill bits 100, the number, size, configuration and/or location of respective cutting elements 360 disposed on exterior portions of each blade 330*a*-330*b* may be varied in accordance with teachings of the present disclosure.

For purposes of describing various features of the present disclosure, cutting elements 360 may sometimes be designated as 360*a*, 360*b*, 360*c*, etc. Respective cutting elements 360 may be disposed on blades 330*a*-330*e* extending from respective first cutting element 360*a* located closest to associated bit rotational axis 104 to respective last cutting elements 360*k* located adjacent to associated gage pad 340*a*-340*e*.

One aspect of the present disclosure may include determining respective locations for respective first cutting element 360*a* on exterior portions of each blade 330*a*-330*e* relative to associated bit rotational axis 104. The respective location for each first cutting element 360*a* relative to associated bit rotational axis 104 may be varied depending upon anticipated downhole drilling conditions and/or the dimensions, configuration and size of rotary drill bit 300. For some applications, the location of each first cutting element 360*a* may be selected in a manner such as described with respect to first cutting elements 160*a* associated with rotary drill bit 100 or first cutting elements 460*a* associated with rotary drill bit 400.

Fixed cutter rotary drill bits may sometimes be formed with a plurality of blades having relatively symmetrical configurations, dimensions and locations relative to an associated bit rotational axis. For other applications fixed cutter rotary drill bits may be formed with a plurality of blades having asymmetrical configurations, dimensions and/or locations relative to an associated bit rotational axis. Varying the configuration, dimensions and/or locations of blades disposed on exterior portions of a rotary drill bit may sometimes improve downhole drilling stability of the associated rotary drill bit, particularly when drilling a directional wellbore. As a result of optimizing the configuration, location and/or dimensions of each blade disposed on exterior portions of a rotary drill bit, it may not always be possible to place the last cutting element on a blade immediately adjacent to an associated gage pad. See for example blade 330*b* as shown in FIG. 5 with respective last cutting element 360*k* spaced from downhole edge 342*b* of gage pad 340*b*.

For embodiments where the configuration, dimensions and/or other designed parameters associated with one or more blades of a fixed cutter rotary drill bit prevent placing the respective last cutting element on one or more blades immediately adjacent to an associated gage pad, the number, dimensions and/or configurations of cutting elements disposed on such blades may be varied to minimize or reduce any gap or noncontiguous cutting zone disposed between each last cutting element and a downhole edge of an associated gage pad.

However, downhole drilling conditions and particularly directional drilling conditions may require placing substantially full size or relatively large cutting elements on exterior portions of each blade adjacent to an associated gage pad. During directional drilling, placing a full size cutting element or relatively large element adjacent to an associated gage pad may improve directional drilling capabilities and enhance reaming of an associated wellbore to have a more uniform inside diameter, especially proximate a kick off location for a directional wellbore. See FIG. 12C. Therefore, even though the number, size and/or configuration of cutting elements disposed on a blade may be varied, a small gap may still occur between the last cutting element and the downhole edge of an associated gage pad. See respective gaps 334 on blades 330*b* and 330*d* in FIG. 10.

The configuration and dimensions of any gap or noncontiguous zone may be selected to be less than corresponding dimension of a cutting surface or cutting face of an adjacent cutting element. Last cutting elements 360*k* of rotary drill bit 300 may have approximately eighty percent overlap with respect to each other. As discussed with respect to rotary drill bits 500 (See FIGS. 7A and 7B) and 600 (See FIGS. 8A and 8B), the size and/or configuration of one or more last cutting elements may be modified in accordance with teachings of the present disclosure.

Figure 6:
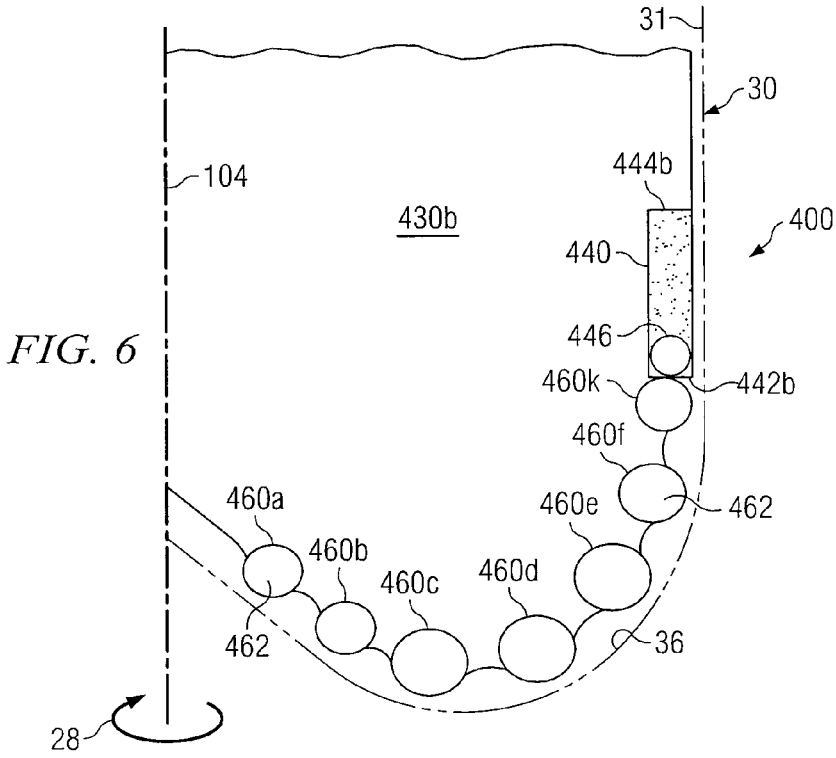
FIG. 6 is a schematic drawing in section with portions broken away showing still another example of a rotary drill bit with cutting elements disposed on a blade in accordance with teachings of the present disclosure.
Figure 11:
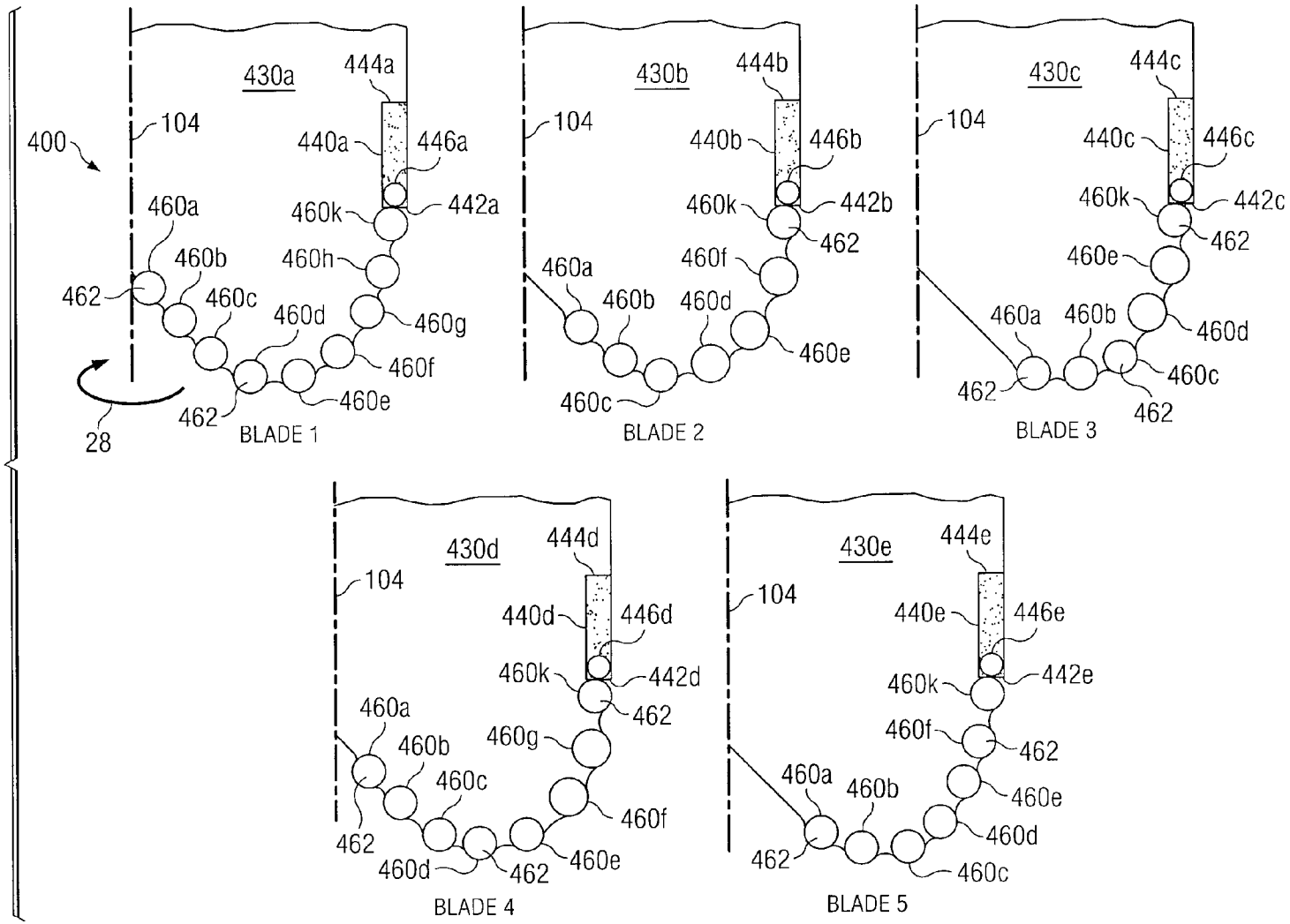
FIG. 11 is a schematic drawing in section with portions broken away showing still another example of five blades of a rotary drill bit having respective cutting elements disposed on each blade in accordance with teachings of the present disclosure.

FIGS. 6 and 11 show another example of a fix cutter rotary drill bit incorporating teachings of the present disclosure. Various aspects of the present disclosure may be described with respect to blades 430*a*-430*e*, respective cutting elements 460 and respective gage pads 440 of rotary drill bit 400. Blades 430*a*-430*e* associated with rotary drill bit 400 are shown in more detail in FIG. 11. Each cutting element 460 may include respective cutting surface or cutting face 462. The number, size, configuration and/or location of respective cutting elements 460 disposed on exterior portions of each blade 430*a*-430*b* may be varied in accordance with teachings of the present disclosure.

Respective cutting elements 460 may be disposed on blades 430*a*-430*e* between respective first cutting element 460*a* located closest to associated bit rotational axis 104 and respective last cutting elements 460*k* located proximate to associated gage pads 440*a*-440*e*. Since the number of cutting elements 460 disposed on each blade 430*a*-430*e* may vary, the designation of respective last cutting element 460 disposed on blade 430*a*-430*e* may vary.

The location of respective last cutting elements 460*k* of each blade 430*a*-430*e* may be selected to be as close as possible to respective downhole edge 442 of each gage pad 440. For example, last cutting element 460*k* of blade 430*a* may be disposed immediately adjacent to downhole edge 442*a* of gage pad 440*a*. Last cutting element 460*k* of blade 430*b* may be disposed immediately adjacent to downhole edge 442*b* of gage pad 440*b*. Last cutting element 460*k* of blade 430*c* may be disposed immediately adjacent to downhole edge 442*c* of gage pad 440*c*. Last cutting element 460*k* of blade 430*d* may be disposed immediately adjacent to downhole edge 442*d* of gage pad 440*d*. Last cutting element 460*k* of blade 430*e* may be disposed immediately adjacent to downhole edge 442*e* of gage pad 440*e*.

As previously noted, one aspect of the present disclosure may include determining respective locations for each first cutting element 460*a* on exterior portions of each blade 430*a*-430*e* relative to associated bit rotational axis 104. First cutting element 460*a* of blade 430*b* may be disposed at an increasing radial distance from bit rotational axis 104 as compared with first cutting element 460*a* of blade 430*a*. In a similar manner respective first cutting element 460*a* of blade 430*c* may be disposed at an even greater radial distance from bit rotational axis 104.

Respective first cutting element 460*a* of blade 130*d* may be disposed at a position relative to bit rotational axis 104 intermediate the radial locations of first cutting element 460*a* on blade 430*a* and first cutting element 460*a* on blade 430*b* relative to associated bit rotational axis 104. In a similar manner respective first cutting element 460*a* of blade 430*e* may be disposed at a location relative to bit rotational axis 104 intermediate the location of first cutting element 460*a* on blade 430*b* and first cutting element 460*a* on blade 430*c*. The radial location of respective first cutting elements 460*a* on each blade 430*a*-430*e* relative to associated bit rotational axis 104 may be varied depending upon the size and/or configuration of associated rotary drill bit 400, associated blades 430 and/or cutting elements 460 disposed thereon.

Depending upon anticipated downhole drilling conditions and particularly with respect to forming a directional wellbore using rotary drill bit 400, additional cutting elements 446 may be disposed in each gage pad 440*a*-440*b*. For embodiments represented by rotary drill bit 400, one or more additional cutting elements 446 may be located proximate respective last cutting elements 460*k*. For some applications additional cutting elements 446*a*-446*e* may have a configuration and size similar to impact arrestors 270 as shown in FIG. 2. Additional cutting elements 446*a*-446*e* may sometimes be generally described as "drop-in" cutters or cutting elements. Additional cutting elements 446*a*-446*e* may function as reamers to maintain a relative uniform inside diameter of a wellbore formed by rotary drill bit 400.

Placing an additional cutting element in associated gage pads may substantially improve reaming of a wellbore formed by an associated rotary drill bit, particularly proximate a kick off location when transitioning from a generally straight wellbore to a wellbore having a curve or radius. See for example transition location 31 disposed between wellbores 30 and 30*a* as shown in FIG. 1.

Figure 7A:
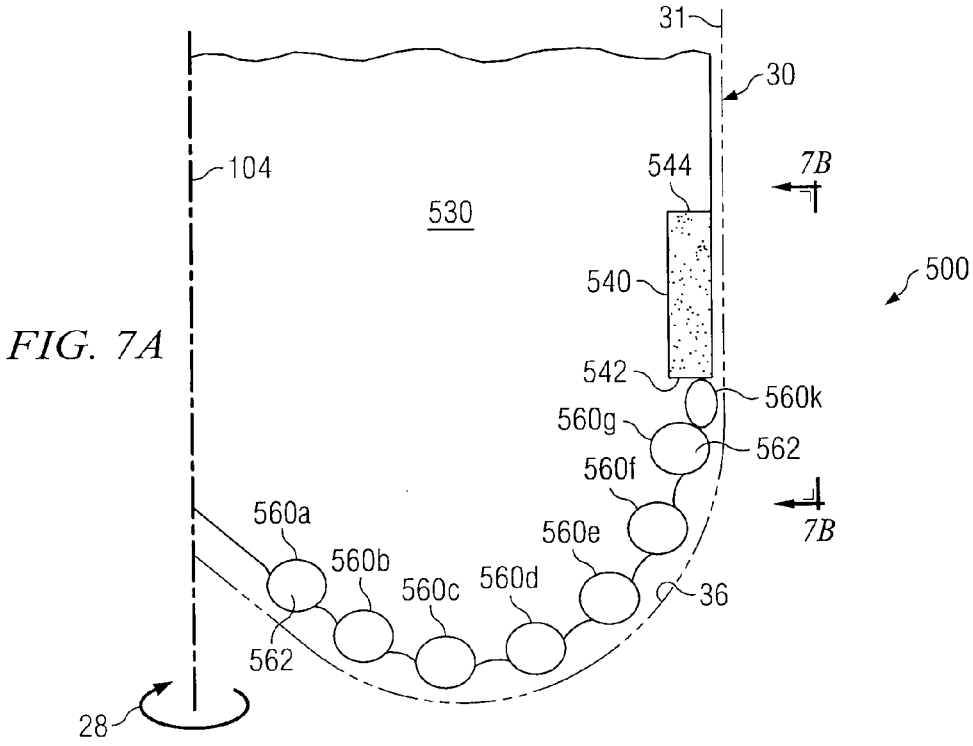
FIG. 7A is a schematic drawing in section with portions broken away showing another example of a rotary drill bit having cutting elements disposed on a blade in accordance with teachings of the present disclosure.
Figure 7B:
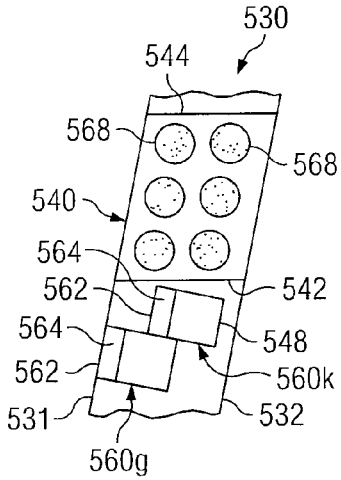
FIG. 7B is a schematic drawing in section with portions broken away taken along lines 7B-7B of FIG. 7A.

For some applications the configuration and/or dimensions of a blade and/or other portions of a rotary drill bit may result in placing an associated last cutting element at a location which does not provide desired overlap with respective last cutting elements of the other blades on the rotary drill bit. For embodiments represented by FIGS. 7A and 7B, blade 530 of rotary drill bit 500 may include next to last cutting element 560*g* disposed on exterior portions of blade 530 at a greater distance than desired from downhole edge 542 of associated gage pad 540. For such embodiments, last cutting element 560*k* may be disposed on exterior portions of associated blade 530 by offsetting last cutting element 560*k* and associated cutting face 562 from leading edge 531 of blade 530. Trailing edge 532 is also shown in FIG. 7B.

Although cutting face 562 may not be disposed immediately adjacent to leading edge 531, last cutting element 560*k* may still satisfactorily remove adjacent portions of formation material to prevent formation of a bridge or ring of uncut formation material on the inside diameter of a wellbore formed by rotary drill bit 500. Even though the dimensions of last cutting element 560*k* and associated cutting face 562 may be smaller than corresponding dimensions of other cutting elements 560 disposed on blade 530 of rotary drill bit 500, last cutting element 560*k* may still be able to remove formation materials with substantially less force than required to remove a ring or bridge of uncut formation material using gage pad 540. For embodiments represented by rotary drill bit 500, a plurality of compacts 568 may also be disposed in exterior portions of gage pad 540.

Figure 8A:
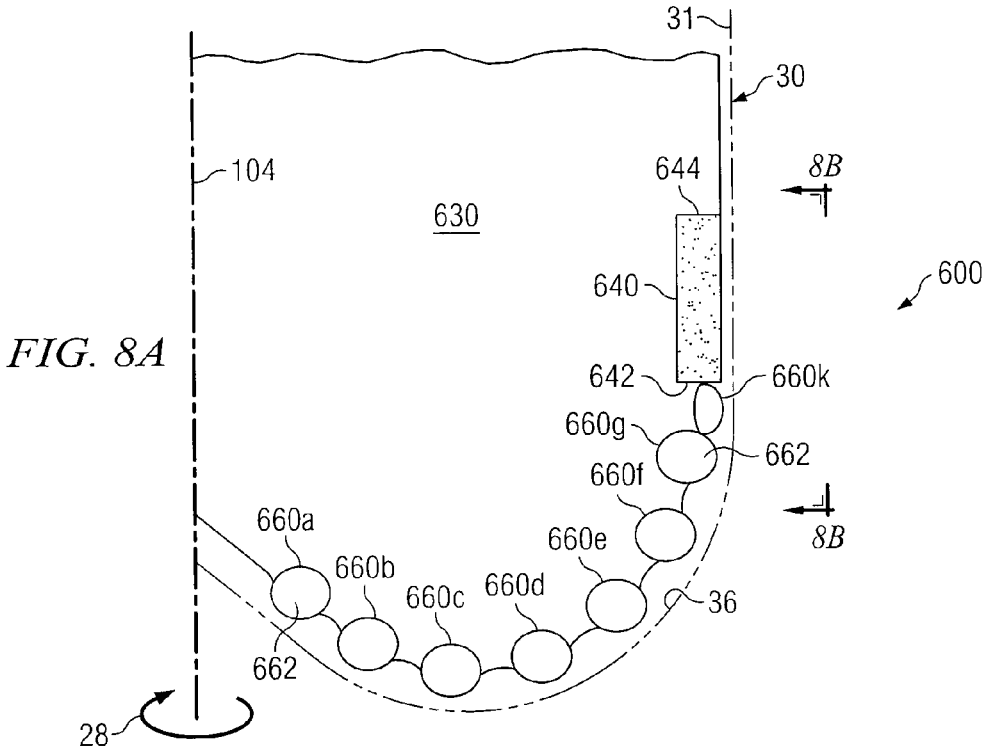
FIG. 8A is a schematic drawing in section with portions broken away showing a further example of a rotary drill bit having cutting elements disposed on a blade in accordance with teachings of the present disclosure.
Figure 8B:
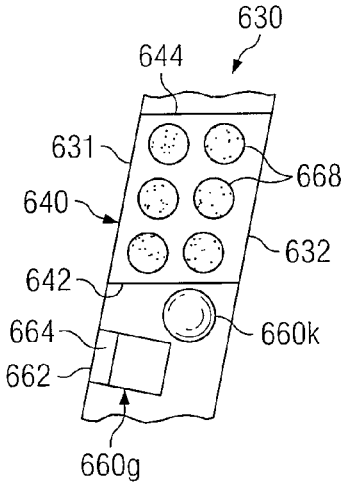
FIG. 8B is a schematic drawing in section with portions broken away taken along 8B-8B of FIG. 8A.

As previously noted, sometimes the configuration and/or dimensions of a blade and/or other portions of a rotary drill bit may prevent placing a last cutting element on the blade at a location which provides sufficient overlap with respective last cutting elements disposed on other blades of the rotary drill bit. For embodiments represented by blade 630 of rotary drill bit 600 as shown in FIGS. 8A and 8B, next to last cutting element 660*g* may be place on exterior portions of blade 630 at a greater distance than desired from downhole edge 642 of associated gage pad 640. For such embodiments, last cutting element 660*k* may be disposed on exterior portions of blade 630 offset from leading edge 631 of blade 630. See FIG. 8B. Trailing edge 632 is also shown in FIG. 8B.

For some applications last cutting element 660*k* may have the general configuration of an impact arrestor similar to impact arrestor 270 as shown in FIG. 2. Although the dimensions and configuration of a cutting surface or cutting face associated with last cutting element 660*k* may be smaller than corresponding cutting surfaces of other cutting elements 660 disposed on blade 630, last cutting element 660*k* may still require substantially less force to remove adjacent portions of formation material as compared with gage pad 640 removing a ring of uncut material or a bridge disposed on an inside diameter of a wellbore formed by rotary drill bit 600. For embodiments represented by rotary drill bit 600, a plurality of compacts 668 may be exposed on exterior portions of gage pad 640.

Figure 12A:
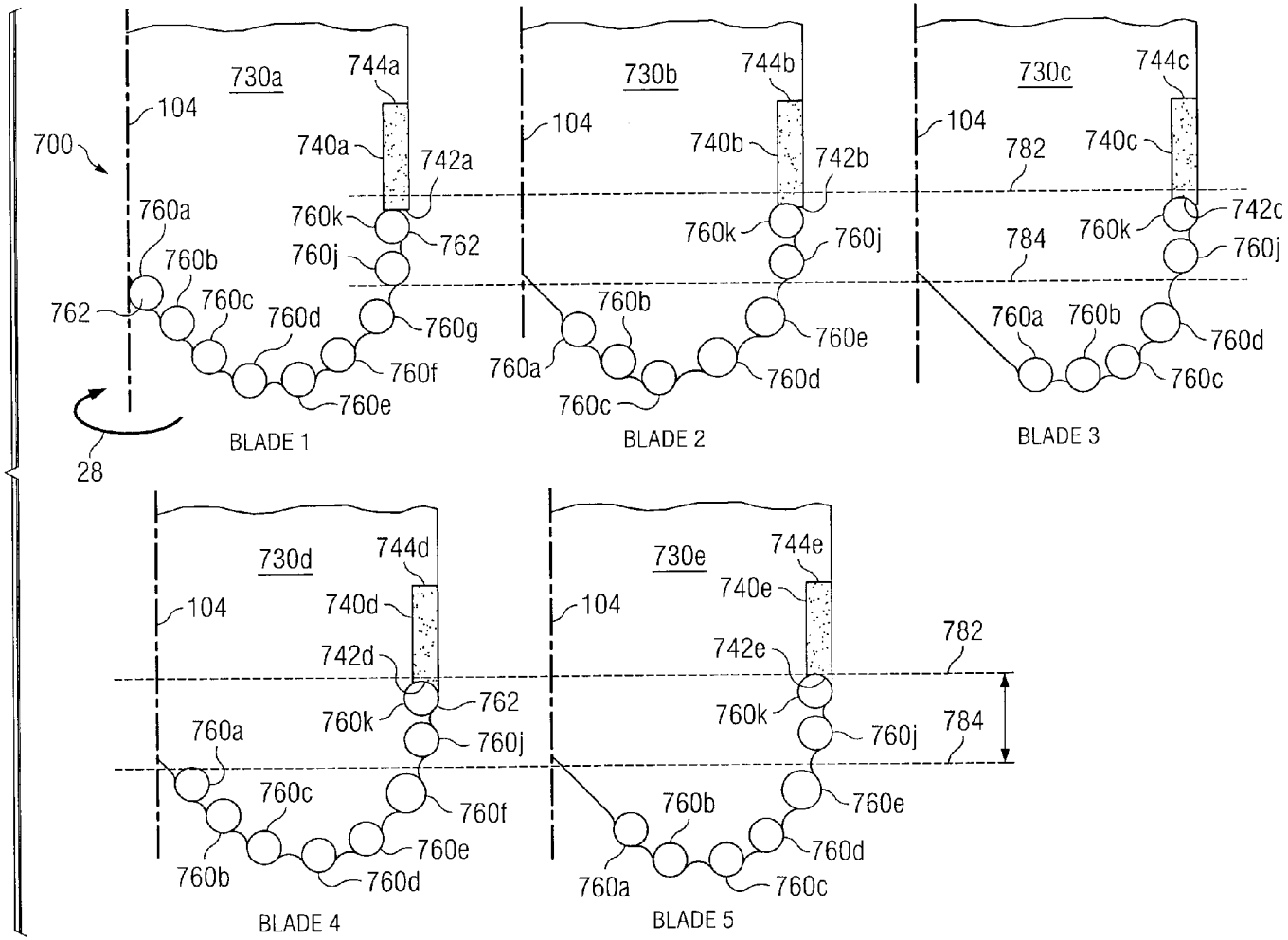
FIG. 12A is a schematic drawing in section with portions broken away showing five blades of a rotary drill bit having respective cutting elements disposed on each blade to form an active gage for directional drilling of a wellbore in accordance with teachings of the present disclosure.
Figure 12B:
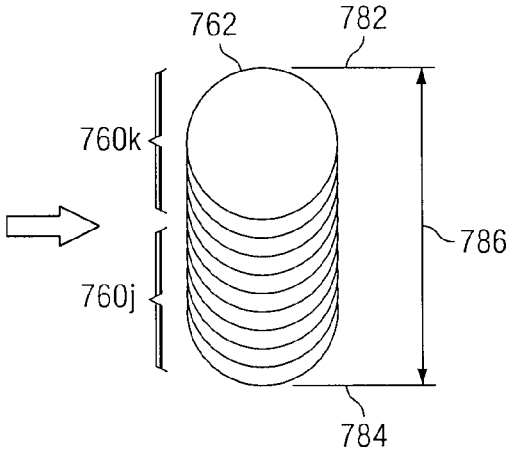
FIG. 12B is a schematic drawing showing a projection of overlapping cutting faces of respective last cutting elements and respective next to last cutting elements disposed on the five blades shown in FIG. 12A.
Figure 12C:
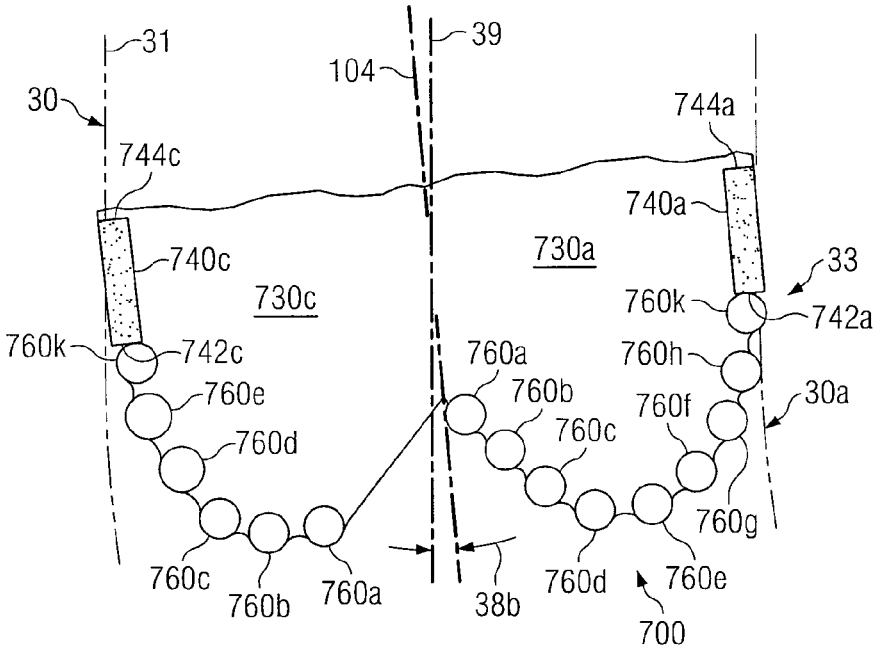
FIG. 12C is a schematic drawing in section with portions broken away showing the rotary drill bit of FIG. 12A disposed in a wellbore proximate a kickoff location associated with forming a directional segment of a wellbore extending from a generally vertical segment of the wellbore.

FIGS. 12A, 12B AND 12C show various embodiments of the present disclosure as represented by rotary drill bit 700. For purposes of describing various features of the present disclosure, cutting elements 760 may be designated as 760*b*, 760*c*, 760*d*, etc. disposed between respective first cutting elements 760*a* located closest to bit rotational axis 104 and respective last cutting elements 760*k* located proximate associated gage pads 740*a*-740*e*. See FIG. 12A.

The number, size, configuration and/or location of respective cutting elements 760 disposed on exterior portions of each blade 730*a*-730*e* may be varied according to teachings of the present disclosure. Also, the height or elevation of gage pads 740*a*-740*e* and respective last cutting elements 760*k* measured along associated bit rotational axis 104 may be varied to provide an active gage operable to improve directional drilling characteristics of rotary drill bit 700. For embodiments of the present disclosure as shown in FIGS. 12A and 12B, active gage 786 may be formed on rotary drill bit 700 between lines 782 and 784 which extend radially from associated bit rotational axis 104. Active gage 786 may also be described as an active gage segment, active gage region and/or active gage portion.

Respective locations of downhole edges 742 of associated gage pads 740 may be varied relative to lines 782 and 784 extending from bit rotational axis 104. For example, downhole edge 742*e* of gage pad 740*e* may terminate proximate line 782. The location or height of gage pads 740*a*, 740*b*, 740*c* and 740*d* may be varied on exterior portions of associated blades 730*a*, 730*b*, 730*c* and 730*d* as measured along associated bit rotational axis 104 such that respective downhole edges 742*a*, 742*b*, 742*c* and 742*d* extend below line 782 by a desired amount.

One aspect of the present disclosure may include determining respective locations for each last cutting element 760*k* and/or next to last cutting elements 760*j* disposed on exterior portions of blades 730*a*-730*e* relative to associated bit rotational axis 104. Varying the location of gage pads 740*a*-740*e*, last cutting elements 760*k* and next to last cutting elements 760*j* in accordance with teachings of the present disclosure will optimize overlap between respective cutting surfaces 762 of last cutting elements 760*k* and next to last cutting elements 760*j* to avoid creating one or more rings or partial rings of uncut formation material during each rotation of rotary drill bit 700. See FIG. 12B for one example of such overlap.

Another aspect of the present disclosure may include determining respective locations for first cutting element 760*a* on exterior portions of blades 730*a*-730*e* relative to associated bit rotational axis 104. For blade 730*a* respective first cutting element 760*a* may be disposed on exterior portions of blade 730*a* relatively close to bit rotational axis 104. First cutting element 760*a* of blade 730*b* may be disposed at an increased radial distance from bit rotational axis 704 as compared to first cutting element 760*a* on blade 730*a*. In a similar manner respective first cutting element 760*a* of blade 730*c* may be disposed at an even greater radial distance from bit rotational axis 104. The location of each first cutting element may be varied based on various parameters of an associate rotary drill bit, blades, cutting elements and/or cutting surfaces. The location of each first cutting element may also be varied based on anticipated downhole drilling conditions.

The location of respective last cutting elements 760*k* and next to last cutting elements 760*j* on blades 730*a*-730*e* may then be selected to provide desired overlap of associated cutting faces 762 to form active gage region 786 on exterior portions of rotary drill bit 700. See FIG. 12B. As a result of placing respective last cutting elements 760*k* and next to last cutting elements 760*j* on exterior portions of blades 730*a*-

730*e* as shown in FIG. 12A, each rotation rotary drill bit 700 results in active gage region 786 interacting with and removing any ring or partial ring of uncut formation material over a length of an associated wellbore corresponding with the distance between lines 782 and 784. Steerability of rotary drill bit 700 may be enhanced since forces associated with active gage region 786 correspond generally with forces associated with a conventional cutting element interacting with formation material. As previously noted interaction between formation materials and a gage pad and/or other noncutting elements may result in substantially greater forces which have a negative effect on steerability of an associated rotary drill bit.

The location of each gage pad 740*a*-740*e* as measured along associated bit rotational axis 104 may be varied so that downhole edges 742*a*-742*e* are disposed as close as possible to respective last cutting elements 760*k*. Varying the location of gage pads 740*a*-740*e* may avoid creating any gaps between lower edge 742 of respective gage pad 740*a*-740*e* and associated last cutting elements 760*k*. Respective next to last cutting element 760*j* on each blade 730*a*-730*e* may also be disposed at substantially the same location relative to respective last cutting elements 760*k*. Alternatively, the location of one or more next to last cutting elements 760*k* may be varied as compared with respective last cutting elements 760*g* to provide desired overlap of associated cutting surfaces 762 to form an active gage region in accordance with teachings of the present disclosure. The other respective cutting elements 760 may then be disposed on exterior portions of each blade 730*a*-730*e* between respective first cutting element 760*a* and respective next to last cutting elements 760*j*. See FIG. 12A.

For some applications respective last cutting elements 760*k* and respective next to last cutting element 760*j* disposed on each blade 730*a*-730*e* may have approximately the same configuration and dimensions. For other applications respective last cutting elements 760*k* may have various dimensions and configurations as compared with respective next to last cutting elements 760*j*.

Placing the last cutting element on each blade immediately adjacent to a downhole edge of an associated gage pad may provide a substantially continuous or contiguous cutting zone from each last cutting element to the associated gage pad. For some embodiments respective last cutting elements and respective next to last cutting elements may be disposed on each blade such that each next to last cutting element may overlap approximately one hundred percent (100%) with the other next to last cutting elements. For example, next to last cutting element 760*j* may be disposed at a location on blade 730*a* which overlaps approximately eighty percent (80%) with next to last cutting elements 760*j* disposed on blade 730*b*, next to last cutting element 760*j* disposed on blade 730*c*, next to last cutting element 760*j* disposed on blade 730*d* and next to last cutting element 760*j* disposed on blade 730*e*. For other applications each next to last cutting element 760*j* may overlap the other next to last cutting elements 760*j* by approximately ninety percent (90%) or seventy percent (70%).

FIG. 12C is a schematic drawing in section and in elevation with portions broken away showing rotary drill bit 700 located proximate transition or kickoff location 33 between wellbore segments 30 and 30*a*. For embodiments represented by FIG. 12C, rotary drill bit 700 is shown with bit rotational axis 104 tilted at angle 38*b* relative to longitudinal axis 39 of vertical wellbore segment 30. Rotary drill bit 700 may follow angle 38*b* to form directional wellbore segment 30*a*. At kickoff location 33, angle 38*b* may be relatively small. As the angle of associated directional wellbore 30*a* increases or builds, angle 38*b* may also increase or build. See for example angle 38*a* in FIG. 3.

For some embodiments last cutting elements 760*k* and next to last cutting elements 760*j* of blade 730*a* may both engage adjacent portions of inside diameter 31 of wellbore segments 30 and 30*a* adjacent to transition or kickoff location 33. During one revolution of rotary drill bit 700 proximate kickoff location 33, cutting faces 762 of last cutting elements 760*k* and cutting faces 762 of next to last cutting elements 760*j* may contact adjacent formation materials along a distance corresponding with the length of active gage region 786.

Although the present disclosure and its advantages have been described in detail, it should be understood that various changes, substitutions and alternations can be made herein without departing from the spirit and scope of the disclosure as defined by the following claims.

What is claimed is:

1. A rotary drill bit operable to form a wellbore in a downhole formation comprising:
- a bit body having one end operable for connection to a drill string;
- a bit rotational axis extending through the bit body;
- a bit face profile defined in part by a plurality of blades disposed on exterior portions of the bit body;
- each blade having an associated gage pad;
- a plurality of cutting elements disposed on exterior portions of each blade;
- a respective first cutting element disposed on each blade at a respective first radial distance from the bit rotational axis, wherein the respective first radial distance for at least one blade varies from the respective first radial distance for at least one other blade;
- a respective last cutting element disposed on each blade adjacent to the associated gage pad, each last cutting element disposed on each blade at the same height measured parallel to the bit rotational axis;
- the other cutting elements disposed on exterior portions of each blade between the respective first cutting element and the respective last cutting element;
- a gage cutter disposed on each blade in the associated gage pad immediately adjacent to the respective last cutting element;
- a respective gap formed between adjacent cutting elements on each blade, wherein the respective gap between adjacent cutting elements on at least one blade varies from the respective gap between adjacent cutting elements on at least one other blade;
- each cutting element operable to form a kerf in adjacent portions of the downhole formation in response to rotation of the drill bit; and
- the respective last cutting element of each blade operable to form a kerf overlapping with at least portions of kerfs formed by each of the respective last cutting elements of the other blades.

2. The rotary drill bit of claim 1 further comprising the first cutting element and the last cutting element of each blade having approximately the same overall dimensions and configuration.

3. The rotary drill bit of claim 1 further comprising the first cutting element and the last cutting element on each blade having different dimensions and configurations.

4. The rotary drill bit of claim 1 wherein the other cutting elements disposed between the respective first cutting element and the last respective cutting element comprise various dimensions and configurations.

5. The rotary drill bit of claim 1 further comprising the other cutting elements spaced from each other between the respective first cutting element and the respective last cutting element according to a pre-defined overlap rule selected to avoid forming rings or partial rings of uncut formation materials.

6. The rotary drill bit of claim 1 further comprising the last cutting element of each blade disposed immediately adjacent to the associated gage pad.

7. The rotary drill bit of claim 1 wherein the respective last cutting element comprises a compact.

8. A rotary drill bit operable to form a wellbore comprising:

a bit body having one end operable for releasable engagement with a drill string;

a bit rotational axis extending through the bit body;

a bit face profile defined in part by a plurality of blades disposed on exterior portions of the bit body;

each blade having a respective gage pad;

a plurality of cutting elements disposed on exterior portions of each blade;

a first cutting element disposed on each blade at a respective first distance from the bit rotational axis, wherein the respective first distance for at least one blade varies from the respective first distance for at least one other blade;

a last cutting element disposed on each blade proximate the respective gage pad, each last cutting element disposed on each blade at the same height measured parallel to the bit rotational axis;

the other cutting elements disposed on exterior portions of each blade between the associated first cutting element and the associated last cutting element;

a gage cutter disposed on each blade in the associated gage pad immediately adjacent to the respective last cutting element;

an open space disposed on each blade between adjacent cutting elements on each blade, wherein the open space between adjacent cutting elements on at least one blade varies from the open space between adjacent cutting elements on at least one other blade; and the last cutting element on each blade cooperating with the respective gage pad, during rotation of the drill bit, to form the wellbore with a substantially uniform inside diameter with substantially no uncut formation material remaining between the last cutting element and the respective gage pad.

9. The rotary drill bit of claim 8 further comprising the cutting elements having approximately the same configuration and dimensions.

10. The rotary drill bit of claim 8 further comprising the cutting elements having various dimensions and configurations.

11. The rotary drill bit of claim 8 further comprising the last cutting element of at least one blade offset from a leading edge of the blade.

12. The rotary drill bit of claim 8 further comprising the last cutting element of each blade disposed immediately adjacent to and contacting the respective gage pad.

13. A rotary drill bit having a bit body with a plurality of blades disposed on exterior portions of the bit body comprising:

one end of the bit body operable for attachment to a drill string;

a bit rotational axis extending through the bit body;

each blade having an associated gage pad;

a plurality of cutting elements disposed on exterior portions of each blade;

a respective first cutting element disposed on each blade at a respective first radial distance from the bit rotational axis, wherein the respective first radial distance for at least one blade varies from the respective first radial distance for at least one other blade;

a respective last cutting element disposed on each blade close to the associated gage pad, each last cutting element disposed on each blade at the same height measured parallel to the bit rotational axis;

the other cutting elements disposed on exterior portions of each blade between the respective first cutting element and the respective last cutting element;

the cutting elements on each blade spaced from each other to form a respective gap between adjacent cutting elements on each blade, wherein the respective gap between adjacent cutting elements on at least one blade varies from the respective gap between adjacent cutting elements on at least one other blade; and each cutting element operable to form a kerf in adjacent portions of a downhole formation in response to rotation of the drill bit.

14. A rotary drill bit operable to form a wellbore comprising:

a bit body having one end operable to engage a drill string;

a bit rotational axis extending through the bit body;

a bit face profile defined in part by a plurality of blades disposed on exterior portions of the bit body;

each blade having an associated gage pad;

a plurality of cutting elements disposed on exterior portions of each blade;

a respective first cutting element disposed on each blade at a respective first radial distance from the bit rotational axis, wherein the respective first radial distance for at least one blade varies from the respective first radial distance for at least one other blade;

a respective last cutting element disposed on each blade immediately adjacent to and contacting the associated gage pad;

the other cutting elements disposed on exterior portions of each blade between the respective first cutting element and the respective last cutting element;

a gage cutter disposed on each blade in the associated gage pad immediately adjacent to the respective last cutting element;

the cutting elements on each blade spaced from each other to form a respective open space between adjacent cutting elements on each blade, wherein the respective open space between adjacent cutting elements on at least one blade varies from the respective open space between adjacent cutting elements on at least one other blade; and the respective last cutting element on each blade approximately 100 percent overlapping with the respective last cutting element on each other blade.

15. A method of forming a rotary drill bit operable to drill a wellbore in a downhole formation comprising:

forming a bit body having one end operable for connection to a drill string;

forming a plurality of blades disposed on exterior portions of the bit body;

placing a respective first cutting element on an exterior portion of each blade at a respective first radial distance from a bit rotational axis, wherein the respective first radial distance for at least one blade varies from the respective first radial distance for at least one other blade;

placing a respective last cutting element on exterior portions of each blade adjacent to a downhole edge of an associated gage pad such that each last cutting element is disposed on each blade at the same height measured parallel to the bit rotational axis;

disposing a gage cutter on each blade in the associated gage pad immediately adjacent to the respective last cutting element; and placing the remaining cutting elements on exterior portions of each blade between the respective first cutting element and the respective last cutting element, the remaining cutting elements on each blade spaced from each other to form a respective open space between adjacent cutting elements on each blade, wherein the respective open space between adjacent cutting elements on at least one blade varies from the respective open space between adjacent cutting elements on at least one other blade.

16. The method of claim 15 further comprising selecting the location for the last cutting element on each blade immediately adjacent to the downhole edge of the associated gage pad to provide approximately one hundred percent overlap between respective cutting surfaces associated with each last cutting element.

17. The method of claim 15 further comprising:

forming the last cutting element with a cutting face having smaller dimensions than a cutting face of the respective first cutting element;

placing a second to last cutting element having dimensions corresponding approximately with the respective first cutting element adjacent to the last cutting element; and selecting the dimensions of the last cutting element to substantially fill the gap formed between the second to last cutting element and the downhole edge of the associated gage pad.

18. The method of claim 15 further comprising:

forming the last cutting element of at least one blade with a cutting face having smaller dimensions than a cutting face of the associated first cutting element; and placing the formed last cutting element of at least one blade offset from a leading edge of the blade.

19. A rotary drill bit operable to form a wellbore in a downhole formation comprising:

a bit body having one end operable for connection to a drill string;

a bit rotational axis extending through the bit body;

a bit face profile defined in part by a plurality of blades disposed on exterior portions of the bit body;

each blade having an associated gage pad;

a plurality of cutting elements disposed on exterior portions of each blade;

a respective first cutting element disposed on each blade at a respective first radial distance from the bit rotational axis, wherein the respective first radial distance for at least one blade varies from the respective first radial distance for at least one other blade;

a respective last cutting element disposed on each blade adjacent to a downhole edge of the associated gage pad;

the other cutting elements disposed on exterior portions of each blade between the respective first cutting element and the respective last cutting element;

a respective gap formed between adjacent cutting elements on each blade, wherein the respective gap between adjacent cutting elements on at least one blade varies from the respective gap between adjacent cutting elements on at least one other blade; and the last cutting element of each blade having a last cutting face approximately one hundred percent overlapping with the last cutting face of the last cutting element on each of the other blades to form an active gage for directional drilling of a wellbore.

20. The rotary drill bit of claim 19 further comprising at least one of the gage pads disposed at a different height as measured along the associated bit rotational axis as compared with the height of at least one other gage pad as measured along the bit rotational axis.

21. The rotary drill bit of claim 19 further comprising:

each respective next to last cutting element disposed on each blade at a different height as measured along the bit rotational axis; and the next to last cutting elements cooperating with respective last cutting elements to form an active gage region on exterior portions of the rotary drill bit proximate the downhole edge of the associated gage pads.

* * * * *